US007588660B2

(12) United States Patent
Edwards et al.

(10) Patent No.: US 7,588,660 B2
(45) **Date of Patent: *Sep. 15, 2009**

(54) WET-PRESSED TISSUE AND TOWEL PRODUCTS WITH ELEVATED CD STRETCH AND LOW TENSILE RATIOS MADE WITH A HIGH SOLIDS FABRIC CREPE PROCESS

(75) Inventors: Steven L. Edwards, Fremont, WI (US); Stephen J. McCullough, Mount Calvary, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 402 days.

This patent is subject to a terminal disclaimer.

(21) Appl. No.: 11/104,014

(22) Filed: Apr. 12, 2005

(65) Prior Publication Data

US 2005/0241786 A1 Nov. 3, 2005

Related U.S. Application Data

(63) Continuation-in-part of application No. 10/679,862, filed on Oct. 6, 2003, now Pat. No. 7,399,378.

(60) Provisional application No. 60/562,025, filed on Apr. 14, 2004, provisional application No. 60/416,666, filed on Oct. 7, 2002.

(51) Int. Cl.
*B31F 1/12* (2006.01)
*D21H 27/00* (2006.01)

(52) U.S. Cl. ..... 162/109; 162/111; 162/149; 162/117; 428/153; 428/156

(58) Field of Classification Search ..... 162/109, 162/111–113, 115–117, 123–133, 141, 149; 156/183; 428/156, 172, 152–153; 264/282–283
See application file for complete search history.

(56) References Cited

U.S. PATENT DOCUMENTS

| | | | | |
|---|---|---|---|---|
| 3,432,936 | A | 3/1969 | Cole et al. | 34/6 |
| 3,994,771 | A | 11/1976 | Morgan, Jr. et al. | 162/113 |
| 4,102,737 | A | 7/1978 | Morton | 162/113 |
| 4,225,382 | A | 9/1980 | Kearney et al. | |
| 4,356,059 | A | 10/1982 | Hostetler | 162/111 |
| 4,420,372 | A | 12/1983 | Hostetler | 162/280 |
| 4,448,638 | A | 5/1984 | Klowak | 162/112 |
| 4,482,429 | A | 11/1984 | Klowak | 162/111 |
| 4,529,480 | A | 7/1985 | Trokhan | 162/109 |
| 4,551,199 | A | 11/1985 | Weldon | 162/109 |
| 4,552,709 | A | 11/1985 | Koger, II et al. | 264/504 |
| 4,556,450 | A | 12/1985 | Chuang et al. | 162/204 |
| 4,614,679 | A | 9/1986 | Farrington, Jr. et al. | 428/138 |
| 4,637,859 | A | 1/1987 | Trokhan | 162/109 |
| 4,689,119 | A | 8/1987 | Weldon | 162/281 |
| 4,795,530 | A | 1/1989 | Soerens et al. | 162/111 |
| 4,834,838 | A | 5/1989 | Klowak | 162/109 |
| 4,849,054 | A | 7/1989 | Klowak | 162/109 |
| 4,942,077 | A | 7/1990 | Wendt et al. | 428/152 |
| 5,087,324 | A | 2/1992 | Awofeso et al. | 162/111 |
| 5,129,988 | A | 7/1992 | Farrington, Jr. et al. | 162/123 |
| 5,314,584 | A | 5/1994 | Grinnell et al. | 162/109 |
| 5,336,373 | A | 8/1994 | Scattolino et al. | 162/116 |
| 5,348,620 | A | 9/1994 | Hermans et al. | 162/9 |
| 5,366,785 | A | 11/1994 | Sawdai | 428/156 |
| 5,411,636 | A | 5/1995 | Hermans et al. | 162/109 |
| 5,492,598 | A | 2/1996 | Hermans et al. | 162/113 |
| 5,494,554 | A | 2/1996 | Edwards et al. | 162/111 |
| 5,501,768 | A | 3/1996 | Hermans et al. | 162/9 |
| 5,503,715 | A | 4/1996 | Trokhan et al. | 162/296 |
| 5,505,818 | A | 4/1996 | Hermans et al. | 162/113 |
| 5,508,818 | A | 4/1996 | Hamma | 358/403 |
| 5,510,001 | A | 4/1996 | Hermans et al. | 162/113 |
| 5,510,002 | A | 4/1996 | Hermans et al. | 162/113 |
| 5,549,790 | A | 8/1996 | Van Phan | 162/109 |
| 5,556,509 | A | 9/1996 | Trokhan et al. | 162/111 |
| 5,601,871 | A | 2/1997 | Krzysik et al. | 427/288 |
| 5,607,551 | A | 3/1997 | Farrington, Jr. et al. | 162/109 |

(Continued)

FOREIGN PATENT DOCUMENTS

| | | | |
|---|---|---|---|
| WO | WO 00/14330 | | 3/2000 |
| WO | WO 2004033793 | A2 * | 4/2004 |
| WO | WO 2005103375 | A1 * | 11/2005 |
| WO | WO 2005106117 | A1 * | 11/2005 |
| WO | WO 2007001837 | A2 * | 1/2007 |
| WO | WO 2007139726 | A1 * | 12/2007 |

OTHER PUBLICATIONS

U.S. Appl. No. 11/167,348, filed Jun. 27, 2005, entitled "Low Compaction, Pneumatic Dewatering Process for Producing Absorbent Sheet", of Murray et al.

(Continued)

*Primary Examiner*—José A Fortuna
(74) *Attorney, Agent, or Firm*—Michael W. Ferrell

(57) ABSTRACT

An absorbent sheet of cellulosic fibers includes a mixture of hardwood fibers and softwood fibers arranged in a reticulum having: (i) a plurality of pileated fiber enriched regions of relatively high local basis weight interconnected by way of (ii) a plurality of lower local basis weight linking regions whose fiber orientation is biased along the machine direction between pileated regions interconnected thereby, wherein the sheet exhibits a % CD stretch which is at least about 2.75 times the dry tensile ratio of the sheet. Tensile ratios of from about 0.4 to about 4 are readily achieved.

22 Claims, 9 Drawing Sheets

U.S. PATENT DOCUMENTS

| | | | | |
|---|---|---|---|---|
| 5,609,725 | A | 3/1997 | Van Phan | 162/117 |
| 5,614,293 | A | 3/1997 | Krzysik et al. | 428/211 |
| H1672 | H | 8/1997 | Hermans et al. | |
| 5,656,132 | A | 8/1997 | Farrington, Jr. et al. | 162/117 |
| 5,667,636 | A | 9/1997 | Engel et al. | 162/117 |
| 5,672,248 | A | 9/1997 | Wendt et al. | 162/109 |
| 5,674,590 | A | 10/1997 | Anderson et al. | 428/154 |
| 5,695,607 | A | 12/1997 | Oriaran et al. | 162/112 |
| 5,746,887 | A | 5/1998 | Wendt et al. | 162/109 |
| 5,772,845 | A | 6/1998 | Farrington, Jr. et al. | 162/109 |
| 5,814,190 | A | 9/1998 | Van Phan | 162/111 |
| 5,840,403 | A | 11/1998 | Trokhan et al. | 428/154 |
| 5,851,353 | A | 12/1998 | Fiscus et al. | 162/113 |
| 5,888,347 | A | 3/1999 | Engel et al. | 162/117 |
| 5,932,068 | A | 8/1999 | Farrington, Jr. et al. | 162/117 |
| 5,935,381 | A | 8/1999 | Trokhan et al. | 162/109 |
| 6,017,417 | A | 1/2000 | Wendt et al. | 162/109 |
| 6,080,279 | A | 6/2000 | Hada et al. | 162/290 |
| 6,083,346 | A | 7/2000 | Hermans et al. | 162/115 |
| 6,093,284 | A | 7/2000 | Hada et al. | 162/290 |
| 6,096,169 | A | 8/2000 | Hermans et al. | 162/115 |
| 6,117,525 | A | 9/2000 | Trokhan et al. | 428/154 |
| 6,136,146 | A | 10/2000 | Van Phan et al. | 162/109 |
| 6,139,686 | A | 10/2000 | Trokhan et al. | 162/109 |
| 6,143,135 | A | 11/2000 | Hada et al. | 162/290 |
| 6,149,767 | A | 11/2000 | Hermans et al. | 162/109 |
| 6,149,769 | A | 11/2000 | Mohammadi et al. | 162/111 |
| 6,162,327 | A | 12/2000 | Batra et al. | 162/109 |
| 6,171,442 | B1 | 1/2001 | Farrington, Jr. et al. | 162/129 |
| 6,187,137 | B1 | 2/2001 | Druecke et al. | 162/109 |
| 6,197,154 | B1 | 3/2001 | Chen et al. | 162/109 |
| 6,210,528 | B1 | 4/2001 | Wolkowicz | 162/111 |
| 6,228,220 | B1 | 5/2001 | Hada et al. | 162/203 |
| 6,280,573 | B1 | 8/2001 | Lindsay et al. | 162/198 |
| 6,287,426 | B1 | 9/2001 | Edwards et al. | 162/281 |
| 6,306,257 | B1 | 10/2001 | Hada et al. | 162/290 |
| 6,306,258 | B1 | 10/2001 | Lange et al. | 162/290 |
| 6,318,727 | B1 | 11/2001 | Hada | 277/345 |
| 6,331,230 | B1 | 12/2001 | Hermans et al. | 162/207 |
| 6,350,349 | B1 | 2/2002 | Hermans et al. | 162/111 |
| 6,420,013 | B1 | 7/2002 | Vinson et al. | 428/154 |
| 6,436,234 | B1 | 8/2002 | Chen et al. | 162/109 |
| 6,447,640 | B1 | 9/2002 | Watson et al. | 162/109 |
| 6,447,641 | B1 | 9/2002 | Wolkowicz et al. | 162/109 |
| 6,454,904 | B1 | 9/2002 | Hermans et al. | 162/205 |
| 6,461,474 | B1 | 10/2002 | Lindsay et al. | 162/109 |
| 6,464,829 | B1 | 10/2002 | Chen et al. | 162/109 |
| 6,478,927 | B1 | 11/2002 | Chen et al. | 162/109 |
| 6,497,789 | B1 | 12/2002 | Hermans et al. | 162/205 |
| 6,534,151 | B2 | 3/2003 | Merker | 428/154 |
| 6,547,924 | B2 | 4/2003 | Klerelid et al. | 162/116 |
| 6,551,461 | B2 | 4/2003 | Hermans et al. | 162/207 |
| 6,565,707 | B2 | 5/2003 | Behnke et al. | 162/112 |
| 6,579,418 | B2 | 6/2003 | Lindsay et al. | 162/198 |
| 6,585,855 | B2 | 7/2003 | Drew et al. | 162/109 |
| 6,607,638 | B2 | 8/2003 | Drew et al. | 162/204 |
| 6,610,173 | B1 | 8/2003 | Lindsay et al. | 162/109 |
| 2003/0098134 | A1 | 5/2003 | Scherb et al. | 162/117 |
| 2003/0102098 | A1 | 6/2003 | Allen et al. | 162/203 |
| 2003/0111195 | A1 | 6/2003 | Hu | 162/111 |
| 2003/0121626 | A1 | 7/2003 | Hultzcrantz | 162/111 |
| 2005/0241786 | A1* | 11/2005 | Edwards et al. | 162/109 |
| 2005/0241787 | A1* | 11/2005 | Murray et al. | 162/113 |
| 2006/0237154 | A1* | 10/2006 | Edwards et al. | 162/111 |
| 2006/0289133 | A1 | 12/2006 | Yeh et al. | 162/109 |
| 2008/0029235 | A1* | 2/2008 | Edwards et al. | 162/111 |
| 2008/0047675 | A1* | 2/2008 | Murray et al. | 162/101 |

OTHER PUBLICATIONS

U.S. Appl. No. 11/151,761, filed Jun. 14, 2005, entitled "High Solids Fabric Crepe Process for Producing Absorbent Sheet with In-Fabric Drying", of Murray et al.

U.S. Appl. No. 11/108,458, filed Apr. 18, 2005, entitled "Fabric Crepe and In Fabric Drying Process for Producing Absorbent Sheet", of Murray et al.

U.S. Appl. No. 11/108,375, filed Apr. 18, 2005, entitled "Fabric Crepe/Draw Process for Producing Absorbent Sheet", of Super et al.

U.S. Appl. No. 10/679,862, filed Oct. 6, 2003, entitled "High Impact Fabric Crepe Process for Making Absorbent Sheet", of Super et al.

U.S. Appl. No. 60/693,699, filed Jun. 24, 2005, entitled "Fabric-Creped Sheet for Dispensers", of Yeh et al.; and.

U.S. Appl. No. 60/673,492, filed Apr. 21, 2005, entitled "Multi-Ply Paper Towel With Sponge-Like Core", of Edwards et al.

U.S. Appl. No. 11/867,113, filed Oct. 4, 2007, Kokko et al.

U.S. Appl. No. 11/804,246, filed May 16, 2007, Edwards et al.

U.S. Appl. No. 11/678,669, filed Feb. 26, 2007, Chou et al.

* cited by examiner

WET-PRESSED TISSUE AND TOWEL PRODUCTS WITH ELEVATED CD STRETCH AND LOW TENSILE RATIOS MADE WITH A HIGH SOLIDS FABRIC CREPE PROCESS

CLAIM FOR PRIORITY AND TECHNICAL FIELD

This application is based upon and claims priority of U.S. Provisional Patent Application Ser. No. 60/562,025, filed Apr. 14, 2004. This application is also a continuation-in-part of U.S. patent application Ser. No. 10/679,862 entitled "Fabric Crepe Process for Making Absorbent Sheet", filed on Oct. 6, 2003, now U.S. Pat. No. 7,399,378, the priority of which is claimed. Further, this application claims the benefit of the filing date of U.S. Provisional Patent Application Ser. No. 60/416,666, filed Oct. 7, 2002. This application is directed, in part, to a process wherein a web is compactively dewatered, creped into a creping fabric and dried wherein processing is controlled to produce products with high CD stretch and low tensile ratios.

BACKGROUND

Methods of making paper tissue, towel, and the like are well known, including various features such as Yankee drying, throughdrying, fabric creping, dry creping, wet creping and so forth. Conventional wet pressing processes have certain advantages over conventional through-air drying processes including: (1) lower energy costs associated with the mechanical removal of water rather than transpiration drying with hot air; and (2) higher production speeds which are more readily achieved with processes which utilize wet pressing to form a web. On the other hand, through-air drying processing has been widely adopted for new capital investment, particularly for the production of soft, bulky, premium quality tissue and towel products.

Fabric creping has been employed in connection with papermaking processes which include mechanical or compactive dewatering of the paper web as a means to influence product properties. See U.S. Pat. Nos. 4,689,119 and 4,551,199 of Weldon; U.S. Pat. Nos. 4,849,054 and 4,834,838 of Klowak; and U.S. Pat. No. 6,287,426 of Edwards et al. Operation of fabric creping processes has been hampered by the difficulty of effectively transferring a web of high or intermediate consistency to a dryer. Note also U.S. Pat. No. 6,350,349 to Hermans et al. which discloses wet transfer of a web from a rotating transfer surface to a fabric. Further patents relating to fabric creping more generally include the following: U.S. Pat. Nos. 4,834,838; 4,482,429 4,445,638 as well as U.S. Pat. No. 4,440,597 to Wells et al.

In connection with papermaking processes, fabric molding has also been employed as a means to provide texture and bulk. In this respect, there is seen in U.S. Pat. No. 6,610,173 to Lindsay et al. a method for imprinting a paper web during a wet pressing event which results in asymmetrical protrusions corresponding to the deflection conduits of a deflection member. The '173 patent reports that a differential velocity transfer during a pressing event serves to improve the molding and imprinting of a web with a deflection member. The tissue webs produced are reported as having particular sets of physical and geometrical properties, such as a pattern densified network and a repeating pattern of protrusions having asymmetrical structures. With respect to wet-molding of a web using textured fabrics, see, also, the following U.S. Pat. Nos.: 6,017,417 and 5,672,248 both to Wendt et al.; U.S. Pat. Nos. 5,505,818 and 5,510,002 to Hermans et al. and U.S. Pat. No. 4,637,859 to Trokhan. With respect to the use of fabrics used to impart texture to a mostly dry sheet, see U.S. Pat. No. 6,585,855 to Drew et al., as well as United States Publication No. US 2003/0000664 A1.

Throughdried, creped products are disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. A relatively permeable web is typically required, making it difficult to employ recycle furnish at levels which may be desired. Transfer to the Yankee typically takes place at web consistencies of from about 60% to about 70%; although in some processes the transfer occurs at much higher consistencies, sometimes even approaching air-dry.

As noted in the above, throughdried products tend to exhibit enhanced bulk and softness; however, thermal dewatering with hot air tends to be energy intensive. Wet-press operations wherein the webs are mechanically dewatered are preferable from an energy perspective and are more readily applied to furnishes containing recycle fiber which tends to form webs with less permeability than virgin fiber. Many improvements relate to increasing the bulk and absorbency of compactively dewatered products which are typically dewatered, in part, with a papermaking felt.

Despite advances in the art, previously known wet press processes have not produced the highly absorbent webs with preferred physical properties especially elevated CD stretch at relatively low MD/CD tensile ratios as are sought after for use in premium tissue and towel products.

In accordance with the present invention, the absorbency, bulk and stretch of a wet-pressed web can be vastly improved by wet fabric creping a web and rearranging the fiber on a creping fabric, while preserving the high speed, thermal efficiency, and furnish tolerance to recycle fiber of conventional wet press processes.

SUMMARY OF THE INVENTION

There is thus provided in a first aspect of the invention an absorbent sheet of cellulosic fibers including a mixture of hardwood fibers and softwood fibers arranged in a reticulum having: (i) a plurality of pileated fiber enriched regions of relatively high local basis weight interconnected by way of (ii) a plurality of lower local basis weight linking regions. The fiber orientation of the linking regions is biased along the direction between pileated regions interconnected thereby. The relative basis weight, degree of pileation, hardwood to softwood ratio, fiber length distribution, fiber orientation, and geometry of the reticulum are controlled such that the sheet exhibits a percent CD stretch of at least about 2.75 times the dry tensile ratio of the sheet. In one preferred embodiment the sheet exhibits a void volume of at least about 5 g/g, a CD stretch of at least about 5 percent and a MD/CD tensile ratio of less than about 1.75. In another preferred embodiment the MD/CD tensile ratio is less than about 1.5. In another preferred embodiment the sheet has an absorbency of at least about 5 g/g, a CD stretch of at least about 10 percent and a MD/CD tensile ratio of less than about 2.5. In a still further preferred embodiment the sheet exhibits an absorbency of at least about 5 g/g, a CD stretch of at least about 15 percent and a MD/CD tensile ratio of less than about 3.5. A CD stretch of at least about 20 percent and a MD/CD tensile ratio of less than about 5 is believed achievable in accordance with the present invention.

As will be seen from the data which follows, a percent CD stretch of at least about 3, 3.25 or 3.5 times the dry tensile ratio is readily achieved in accordance with the present invention.

In general, a percent CD stretch of at least about 4 and a dry tensile ratio of from about 0.4 to about 4 are typical of products of the invention. Preferably, the products have a CD stretch of least about 5 or 6. In some cases a CD stretch of at least about 8 or at least about 10 is preferred.

The inventive products typically have a void volume of at least about 5 or 6 g/g. Void volumes of at least about 7 g/g, 8 g/g, 9 g/g or 10 g/g are likewise typical.

The inventive sheet may consist predominantly (more than 50%) of hardwood fiber or softwood fiber. Typically the sheet includes a mixture of these two fibers.

In another aspect of the invention there is provided a method of making a cellulosic web for tissue or towel products including the steps of: (a) preparing an aqueous cellulosic papermaking furnish; (b) providing the papermaking furnish to a forming fabric as a jet issuing from a head box at a jet speed; (c) compactively dewatering the papermaking furnish to form a nascent web having an apparently random distribution of papermaking fiber; (d) applying the dewatered web having an apparently random fiber distribution to a translating transfer surface moving at a first speed; (e) belt creping the web from the transfer surface at a consistency of from about 30 to about 60 percent utilizing a patterned creping belt, the creping step occurring under pressure in a belt creping nip defined between the transfer surface of the creping belt wherein the belt is traveling at a second speed slower than the speed of said transfer surface. The belt pattern, nip parameters, velocity delta and web consistency are selected such that the web is creped from the transfer surface and redistributed on the creping belt to form a web with a reticulum having a plurality of interconnected regions of different local basis weights including at least (i) a plurality of fiber enriched regions of relatively high local basis weight, interconnected by way of (ii) a plurality of lower local basis weight regions. The web is then dried. It will be seen that the hardwood to softwood ratio, fiber length distribution, overall crepe, jet speed, drying and belt creping steps are controlled and the creping belt pattern is selected such that the web is characterized in that it has a percent CD stretch which is at least about 2.75 times the dry tensile ratio of the web. These parameters are also selected such that the properties noted above in connection with the inventive products are achieved in various embodiments of the invention.

The inventive process may be practiced with predominantly hardwood fiber for producing base sheet for tissue manufacture or the inventive process may be practiced with a furnish consisting predominantly of softwood fiber when it is desired to make towel. It will be appreciated by one of skill in the art that other additives are selected as so desired.

It has been found in accordance with the present invention that the webs having a local variation in basis weight are preferably calendered between steel calender rolls when calendering is desirable.

The belt creped web of the invention is typically characterized in that the fibers of the fiber enriched regions are biased in the cross direction as will be appreciated from the attached photomicrographs.

Generally the process is operated at a fabric crepe of from about 10 to about 100 percent. Preferred embodiments include those wherein the process is operated at a fabric crepe of at least about 40, 60, 80 or 100 percent or more. The inventive process may be operated at a fabric crepe of 125 percent or more.

The process of the present invention is exceedingly furnish tolerant, and can be operated with large amounts of secondary fiber if so desired.

Still further features and advantages of the present invention will become apparent from the discussion which follows.

BRIEF DESCRIPTION OF DRAWINGS

The invention is described in detail below with reference to the Figures, wherein.

DETAILED DESCRIPTION

Figure 1:
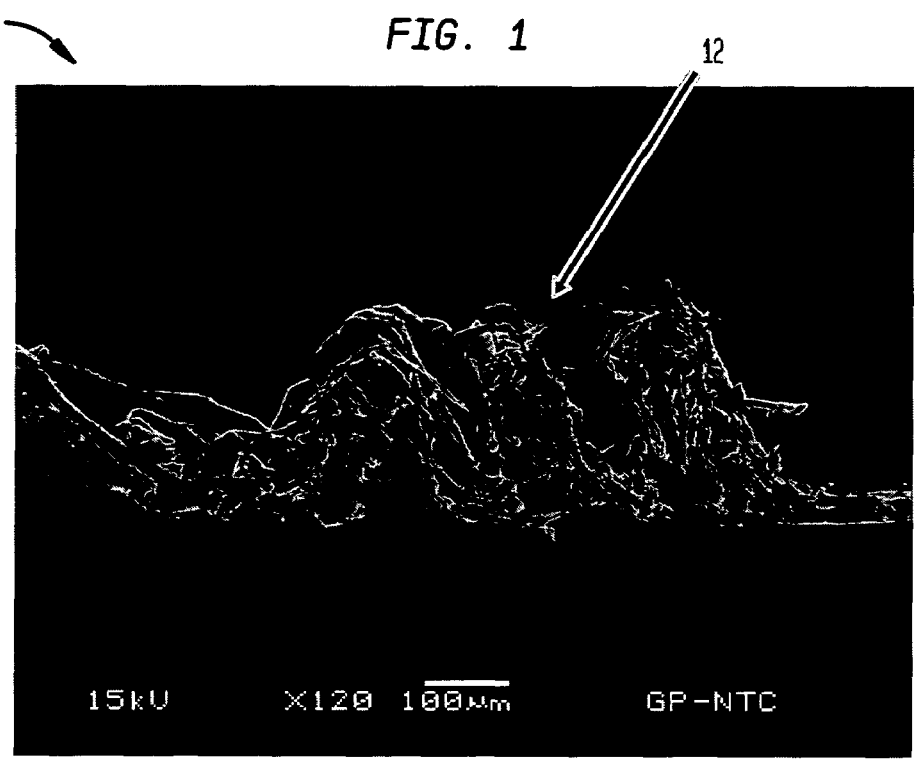
FIG. 1 is a photomicrograph (120×) in section along the machine direction of a fiber enriched region of a fabric creped sheet.

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art.

Terminology used herein is given its ordinary meaning with the exemplary definitions set forth immediately below.

Absorbency of the inventive products (SAT) is measured with a simple absorbency tester. The simple absorbency tester is a particularly useful apparatus for measuring the hydrophilicity and absorbency properties of a sample of tissue, napkins, or towel. In this test a sample of tissue, napkins, or towel 2.0 inches in diameter is mounted between a top flat plastic cover and a bottom grooved sample plate. The tissue, napkin, or towel sample disc is held in place by a ⅛ inch wide circumference flange area. The sample is not compressed by the holder. De-ionized water at 73° F. is introduced to the sample at the center of the bottom sample plate through a 1 mm. diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibation decreases below 0.005 gm water per 5 seconds, the test is terminated. The amount of water removed from the reservoir and absorbed by the sample is weighed and reported as grams of water per square meter of sample unless otherwise indicated. In practice, an M/K Systems Inc. Gravimetric Absorbency Testing System is used. This is a commercial system obtainable from M/K Systems Inc., 12 Garden Street, Danvers, Mass., 01923. WAC or water absorbent capacity also referred to as SAT is actually determined by the instrument itself. WAC is defined as the point where the weight versus time graph has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria; unless "Slow Sat" is specified in which case the cut off criteria is 1 mg in 20 seconds.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented even though, depending on the jet to wire speed, there may be a significant bias toward machine direction orientation making the machine direction tensile strength of the web exceed the cross-direction tensile strength.

Unless otherwise specified, "basis weight", BWT, bwt and so forth refers to the weight of a 3000 square foot ream of product. Consistency refers to percent solids of a nascent web, for example, calculated on a bone dry basis. "Air dry" means including residual moisture, by convention up to about 10 percent moisture for pulp and up to about 6% for paper. A nascent web having 50 percent water and 50 percent bone dry pulp has a consistency of 50 percent.

The term "cellulosic", "cellulosic sheet" and the like is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen and so forth. The products of the present invention may comprise a blend of conventional fibers (whether derived from virgin pulp or recycle sources) and high coarseness lignin-rich tubular fibers, such as bleached chemical thermomechanical pulp (BCTMP). "Furnishes" and like terminology refers to aqueous compositions including papermaking fibers, wet strength resins, debonders and the like for making paper products.

As used herein, the term compactively dewatering the web or furnish refers to mechanical dewatering by wet pressing on a dewatering felt, for example, in some embodiments by use of mechanical pressure applied continuously over the web surface as in a nip between a press roll and a press shoe wherein the web is in contact with a papermaking felt. The terminology "compactively dewatering" is used to distinguish processes wherein the initial dewatering of the web is carried out largely by thermal means as is the case, for example, in U.S. Pat. No. 4,529,480 to Trokhan and U.S. Pat. No. 5,607,551 to Farrington et al. noted above. Compactively dewatering a web thus refers, for example, to removing water from a nascent web having a consistency of less than 30 percent or so by application of pressure thereto and/or increasing the consistency of the web by about 15 percent or more by application of pressure thereto.

"Fabric side" and like terminology refers to the side of the web which is in contact with the creping and drying fabric. "Dryer side" or the like is the side of the web opposite the fabric side of the web.

Fpm refers to feet per minute while consistency refers to the weight percent fiber of the web.

MD means machine direction and CD means cross-machine direction.

Nip parameters include, without limitation, nip pressure, nip length, backing roll hardness, fabric approach angle, fabric takeaway angle, uniformity, and velocity delta between surfaces of the nip.

Nip length means the length over which the nip surfaces are in contact.

"On line" and like terminology refers to a process step performed without removing the web from the papermachine in which the web is produced. A web is drawn or calendered on line when it is drawn or calendered without being severed prior to wind-up.

A translating transfer surface refers to the surface from which the web is creped into the creping fabric. The translating transfer surface may be the surface of a rotating drum as described hereafter, or may be the surface of a continuous smooth moving belt or another moving fabric which may have surface texture and so forth. The translating transfer surface needs to support the web and facilitate the high solids creping as will be appreciated from the discussion which follows.

Calipers and or bulk reported herein may be 1, 4 or 8 sheet calipers. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product is sold. For testing in general, eight sheets are selected and stacked together. For napkin testing, napkins are enfolded prior to stacking. For basesheet testing off of winders, each sheet to be tested must have the same number of plies as produced off the winder. For basesheet testing off of the papermachine reel, single plies must be used. Sheets are stacked together aligned in the MD. On custom embossed or printed product, try to avoid taking measurements in these areas if at all possible. Bulk may also be expressed in units of volume/weight by dividing caliper by basis weight.

Dry tensile strengths (MD and CD), stretch, ratios thereof, break modulus, stress and strain are measured with a standard Instron test device or other suitable elongation tensile tester which may be configured in various ways, typically using 3 or 1 inch wide strips of tissue or towel, conditioned at 50% relative humidity and 23° C. (73.4), with the tensile test run at a crosshead speed of 2 in/min.

Tensile ratios are simply ratios of the values determined by way of the foregoing methods. Tensile ratio refers to the MD/CD dry tensile ratio unless otherwise stated. Unless otherwise specified, a tensile property is a dry sheet property. Tensile strength is sometimes referred to simply as tensile. Unless otherwise specified, break tensile strength, stretch and so forth are reported herein.

"Fabric crepe ratio" is an expression of the speed differential between the creping fabric and the forming wire and typically calculated as the ratio of the web speed immediately before creping and the web speed immediately following creping, because the forming wire and transfer surface are typically, but not necessarily, operated at the same speed:

Fabric crepe ratio =transfer cylinder speed ÷creping fabric speed

Fabric crepe can also be expressed as a percentage calculated as:

Fabric crepe, percent,=Fabric crepe ratio −1 ×100%

Line crepe (sometimes referred to as overall crepe), reel crepe and so forth are similarly calculated as discussed below.

PLI or pli means pounds force per linear inch.

Predominantly means more than about 50%, typically by weight; bone dry basis when referring to fiber.

Pusey and Jones (P+J) hardness (indentation) sometimes referred to as P+J is measured in accordance with ASTM D 531, and refers to the indentation number (standard specimen and conditions).

Velocity delta means a difference in linear speed.

The void volume and /or void volume ratio as referred to hereafter, are determined by saturating a sheet with a nonpolar POROFIL® liquid and measuring the amount of liquid absorbed. The volume of liquid absorbed is equivalent to the void volume within the sheet structure. The percent weight increase (PWI) is expressed as grams of liquid absorbed per gram of fiber in the sheet structure times 100, as noted hereinafter. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiple samples should be separated into individual single plies and 8 sheets from each ply position used for testing. Weigh and record the dry weight of each test specimen to the nearest 0.0001 gram. Place the specimen in a dish containing POROFIL® liquid having a specific gravity of 1.875 grams per cubic centimeter, available from Coulter Electronics Ltd., Northwell Drive, Luton, Beds, England (Part No. 9902458.) After 10 seconds, grasp the specimen at the very edge (1-2 Millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Lt., Maidstone, England) in order to remove any excess of the last partial drop. Immediately weigh the specimen, within 10 seconds, recording the weight to the nearest 0.0001 gram. The PWI for each specimen, expressed as grams of POROFIL® per gram of fiber, is calculated as follows:

$$PWI=[(W_2-W_1)/W_1]\times 100\%$$

wherein

"$W_1$" is the dry weight of the specimen, in grams; and

"$W_2$" is the wet weight of the specimen, in grams.

The PWI for all eight individual specimens is determined as described above and the average of the eight specimens is the PWI for the sample.

The void volume ratio is calculated by dividing the PWI by 1.9 (density of fluid) to express the ratio as a percentage, whereas the void volume (gms/gm) is simply the weight increase ratio; that is, PWI divided by 100.

According to the present invention, an absorbent paper web is made by dispersing papermaking fibers into aqueous furnish (slurry) and depositing the aqueous furnish onto the forming wire of a papermaking machine, typically by way of a jet issuing from a headbox. Any suitable forming scheme might be used. For example, an extensive but non-exhaustive list in addition to Fourdrinier formers includes a crescent former, a C-wrap twin wire former, an S-wrap twin wire former, or a suction breast roll former. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808 all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon fabric-creping. Foam-forming techniques are disclosed in U.S. Pat. No. 4,543,156 and Canadian Patent No. 2,053,505, the disclosures of which are incorporated herein by reference. The foamed fiber furnish is made up from an aqueous slurry of fibers mixed with a foamed liquid carrier just prior to its introduction to the headbox. The pulp slurry supplied to the system has a consistency in the range of from about 0.5 to about 7 weight percent fibers, preferably in the range of from about 2.5 to about 4.5 weight percent. The pulp slurry is added to a foamed liquid comprising water, air and surfactant containing 50 to 80 percent air by volume forming a foamed fiber furnish having a consistency in the range of from about 0.1 to about 3 weight percent fiber by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom.

The furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof; said chemicals optionally comprising polyols, starches, PPG esters, PEG esters, phospholipids, surfactants, polyamines, HMCP or the like.

The pulp can be mixed with strength adjusting agents such as wet strength agents, dry strength agents and debonders/softeners and so forth. Suitable wet strength agents are known to the skilled artisan. A comprehensive but non-exhaustive list of useful strength aids include urea-formaldehyde resins, melamine formaldehyde resins, glyoxylated polyacrylamide resins, polyamide-epichlorohydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. Nos. 3,556,932 to Coscia et al. and 3,556,933 to Williams et al., both of which are incorporated herein by reference in their entirety. Resins of this type are commercially available under the trade name of PAREZ 631NC by Bayer Corporation. Different mole ratios of acrylamide/-DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del. and Amres® from Georgia-Pacific Resins, Inc. These resins and the process for making the resins are described in U.S. Pat. No. 3,700,623 and U.S. Pat. No. 3,772,076 each of which is incorporated herein by reference in its entirety. An extensive description of polymeric-epihalohydrin resins is given in Chapter 2: *Alkaline-Curing Polymeric Amine-Epichlorohydrin* by Espy in *Wet Strength Resins and Their Application* (L. Chan, Editor, 1994), herein incorporated by reference in its entirety. A reasonably comprehensive list of wet strength resins is described by Westfelt in *Cellulose Chemistry and Technology* Volume 13, p. 813, 1979, which is incorporated herein by reference.

Suitable temporary wet strength agents may likewise be included. A comprehensive but non-exhaustive list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers impart a positive charge to the aldehyde containing reaction product. In addition, other commercially available temporary wet strength agents, such as, PAREZ 745, manufactured by Bayer can be used, along with those disclosed, for example in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus, by National Starch and Chemical Company of Bridgewater, N.J. may be used. Prior to use, the cationic aldehydic water soluble polymer can be prepared by preheating an aqueous slurry of approximately 5% solids maintained at a temperature of approximately 240 degrees Fahrenheit and a pH of about 2.7 for approximately 3.5 minutes. Finally, the slurry can be quenched and diluted by adding water to produce a mixture of approximately 1.0% solids at less than about 130 degrees Fahrenheit.

Other temporary wet strength agents, also available from National Starch and Chemical Company are sold under the trademarks CO-BOND® 1600 and CO-BOND® 2300. These starches are supplied as aqueous colloidal dispersions and do not require preheating prior to use.

Temporary wet strength agents such as glyoxylated polyacrylamide can be used. Temporary wet strength agents such glyoxylated polyacrylamide resins are produced by reacting acrylamide with diallyl dimethyl ammonium chloride (DADMAC) to produce a cationic polyacrylamide copolymer which is ultimately reacted with glyoxal to produce a cationic cross-linking temporary or semi-permanent wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference. Resins of this type are commercially available under the trade name of PAREZ 631NC, by Bayer Industries. Different mole ratios of acrylamide/DADMAC/glyoxal can be used to produce cross-linking resins, which are useful as wet strength agents. Furthermore, other dialdehydes can be substituted for glyoxal to produce wet strength characteristics.

Suitable dry strength agents include starch, guar gum, polyacrylamides, carboxymethyl cellulose and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton of dry strength agent. According to another embodiment, the pulp may contain from about 1 to about 5 lbs/ton of dry strength agent.

Suitable debonders are likewise known to the skilled artisan. Debonders or softeners may also be incorporated into the pulp or sprayed upon the web after its formation. The present invention may also be used with softener materials including but not limited to the class of amido amine salts derived from partially acid neutralized amines. Such materials are disclosed in U.S. Pat. No. 4,720,383. Evans, *Chemistry and Industry,* Jul. 5, 1969, pp. 893-903; Egan, *J. Am. Oil Chemist's Soc.,* Vol. 55 (1978), pp. 118-121; and Trivedi et al., *J. Am. Oil Chemist's Soc.,* June 1981, pp. 754-756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyidimethyl ammonium chloride and are representative biodegradable softeners.

In some embodiments, a particularly preferred debonder composition includes a quaternary amine component as well as a nonionic surfactant.

The nascent web is typically dewatered on a papermaking felt. Any suitable felt may be used. For example, felts can have double-layer base weaves, triple-layer base weaves, or laminated base weaves. Preferred felts are those having the laminated base weave design. A wet-press-felt which may be particularly useful with the present invention is Vector 3 made by Voith Fabric. Background art in the press felt area includes U.S. Pat. Nos. 5,657,797; 5,368,696; 4,973,512; 5,023,132; 5,225,269; 5,182,164; 5,372,876; and 5,618,612. A differential pressing felt as is disclosed in U.S. Pat. No. 4,533,437 to Curran et al. may likewise be utilized.

Any suitable creping belt or fabric may be used. Suitable creping fabrics include single layer, multi-layer, or composite preferably open meshed structures. Fabrics may have at least one of the following characteristics: (1) on the side of the creping fabric that is in contact with the wet web (the "top" side), the number of machine direction (MD) strands per inch (mesh) is from 10 to 200 and the number of cross-direction (CD) strands per inch (count) is also from 10 to 200; (2) The strand diameter is typically smaller than 0.050 inch; (3) on the top side, the distance between the highest point of the MD knuckles and the highest point on the CD knuckles is from about 0.001 to about 0.02 or 0.03 inch; (4) In between these two levels there can be knuckles formed either by MD or CD strands that give the topography a three dimensional hill/valley appearance which is imparted to the sheet during the wet molding step; (5) The fabric may be oriented in any suitable way so as to achieve the desired effect on processing and on properties in the product; the long warp knuckles may be on the top side to increase MD ridges in the product, or the long shute knuckles may be on the top side if more CD ridges are desired to influence creping characteristics as the web is transferred from the transfer cylinder to the creping fabric; and (6) the fabric may be made to show certain geometric patterns that are pleasing to the eye, which is typically repeated between every two to 50 warp yarns. Suitable commercially available coarse fabrics include a number of fabrics made by Voith Fabrics.

The creping fabric may thus be of the class described in U.S. Pat. No. 5,607,551 to Farrington et al, Cols. 7-8 thereof, as well as the fabrics described in U.S. Pat. No. 4,239,065 to Trokhan and U.S. Pat. No. 3,974,025 to Ayers. Such fabrics may have about 20 to about 60 meshes per inch and are formed from monofilament polymeric fibers having diameters typically ranging from about 0.008 to about 0.025 inches. Both warp and weft monofilaments may, but need not necessarily be of the same diameter.

In some cases the filaments are so woven and complimentarily serpentinely configured in at least the Z-direction (the thickness of the fabric) to provide a first grouping or array of coplanar top-surface-plane crossovers of both sets of filaments; and a predetermined second grouping or array of sub-top-surface crossovers. The arrays are interspersed so that portions of the top-surface-plane crossovers define an array of wicker-basket-like cavities in the top surface of the fabric which cavities are disposed in staggered relation in both the machine direction (MD) and the cross-machine direction (CD), and so that each cavity spans at least one sub-top-surface crossover. The cavities are discretely perimetrically enclosed in the plan view by a picket-like-lineament comprising portions of a plurality of the top-surface plane crossovers. The loop of fabric may comprise heat set monofilaments of thermoplastic material; the top surfaces of the coplanar top-surface-plane crossovers may be monoplanar flat surfaces. Specific embodiments of the invention include satin weaves as well as hybrid weaves of three or greater sheds, and mesh counts of from about 10×10 to about 120×120 filaments per inch (4×4 to about 47×47 per centimeter). Although the preferred range of mesh counts is from about 18 by 16 to about 55 by 48 filaments per inch (7×6 to about 22×19 per centimeter).

Instead of an impression fabric, a dryer fabric may be used as the creping fabric if so desired. Suitable fabrics are described in U.S. Pat. Nos. 5,449,026 (woven style) and 5,690,149 (stacked MD tape yarn style) to Lee as well as U.S. Pat. No. 4,490,925 to Smith (spiral style).

A creping adhesive used on the Yankee cylinder is preferably capable of cooperating with the web at intermediate moisture to facilitate transfer from the creping fabric to the Yankee and to firmly secure the web to the Yankee cylinder as it is dried to a consistency of 95% or more on the cylinder preferably with a high volume drying hood. The adhesive is critical to stable system operation at high production rates and is a hygroscopic, re-wettable, substantially non-crosslinking adhesive. Examples of preferred adhesives are those which include poly(vinyl alcohol) of the general class described in U.S. Pat. No. 4,528,316 to Soerens et al. Other suitable adhesives are disclosed in co-pending U.S. patent application Ser. No. 10/409,042 (Publication No. US 2005-0006040 A1), filed Apr. 9, 2003, entitled "Creping Adhesive Modifier and Process for Producing Paper Products". The disclosures of the '316 patent and the '042 application are incorporated herein by reference. Suitable adhesives are optionally provided with modifiers and so forth. It is preferred to use crosslinker sparingly or not at all in the adhesive in many cases; such that the resin is substantially non-crosslinkable in use.

Figure 2:
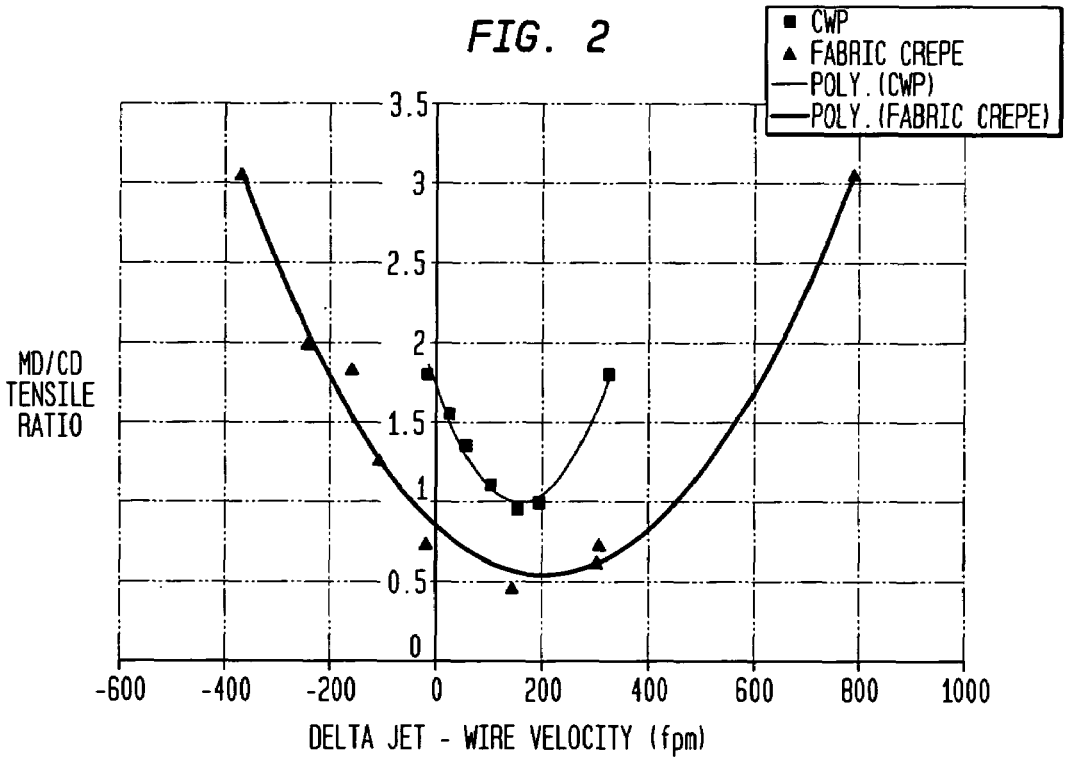
FIG. 2 is a plot of MD/CD dry tensile ratio versus jet/wire velocity delta in feet per minute.

The present invention is appreciated by reference to the Figures, especially FIGS. 1 and 2. FIG. 1 shows a cross-section (120×) along the MD of a fabric-creped, sheet 10 illustrating a fiber-enriched, pileated region 12. It is seen that the web has microfolds transverse to the machine direction, i.e., the ridges or creases extend in the CD (into the photograph). It will be appreciated that fibers of the fiber-enriched region 12 have orientation biased in the CD, especially at the right side of region 12, where the web contacts a knuckle of the creping fabric. The jet/forming wire velocity delta (jet velocity-wire velocity) has an important influence on tensile ratio as is seen in FIG. 2; an influence which is markedly different than that seen in conventional wet pressed products.

FIG. 2 is a plot of MD/CD tensile ratio (strength at break) versus the difference between headbox jet velocity and forming wire speed (fpm). The upper U-shaped curve is typical of conventional wet-press absorbent sheet. The lower, broader curve is typical of fabric-creped product of the invention. It is readily appreciated from FIG. 2 that MD/CD tensiles of below 1.5 or so are achieved in accordance with the invention over a wide range of jet to wire velocity deltas, a range which is more than twice that of the CWP curve shown. Thus control of the headbox jet forming wire velocity may be used to achieve desired sheet properties.

It is also seen from FIG. 2 that MD/CD ratios below square (i.e. below 1) are difficult; if not impossible to obtain with conventional processing. Furthermore, square or below sheets are formed by way of the invention without a lot of fiber aggregates or "flocs" which is not the case with the CWP products with low MD/CD tensile ratios. This difference is due, in part, to the relatively low velocity deltas required to achieve low tensiles in CWP products and may be due in part to the fact that fiber is redistributed on the creping fabric when the web is creped from the transfer surface in accordance with the invention.

In many products, the cross machine properties are more important than the MD properties, particularly in commercial toweling where CD wet strength is critical. A major source of product failure is "tabbing" or tearing off only a piece of towel rather than the intended sheet. In accordance with the invention, CD relative tensiles may be selectively elevated by control of the headbox to forming wire velocity delta and fabric creping.

Figure 3:
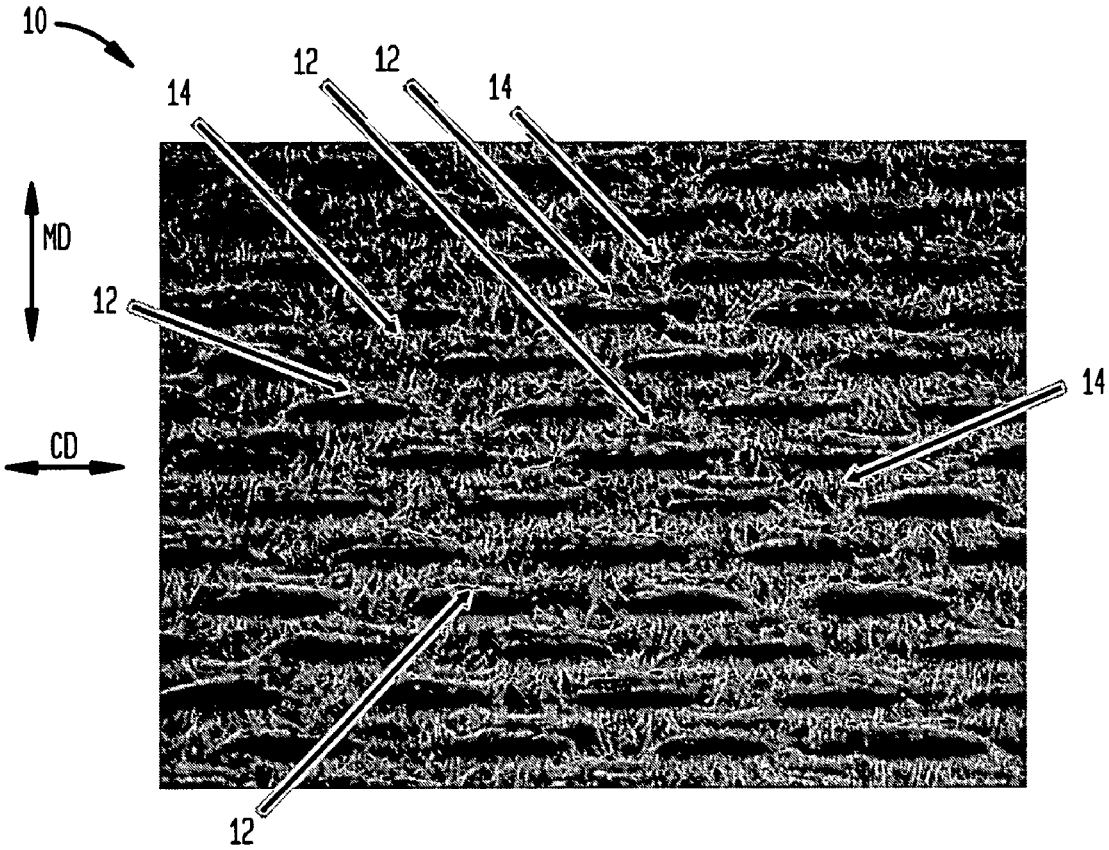
FIG. 3 is a photomicrograph (10×) of the fabric side of a fabric creped web.

FIG. 3 is a photomicrograph (10×) of the fabric side of a fabric-creped web. It is again seen in FIG. 3 that sheet 10 has a plurality of very pronounced high basis weight, fiber-enriched regions 12 having fiber with orientation biased in the cross-machine direction (CD) linked by relatively low basis weight-linking regions 14, which have fiber orientation biased in a direction between pileated or fiber-enriched regions.

Orientation bias is also seen in FIG. 1, especially where the CD-biased fibers of the pileated, fiber-enriched regions 12 have been cut when making the specimens in the center of region 12. To the left of region 12, in the linking region, it is seen that fiber is biased more along the machine direction between fiber-enriched regions. These features are also readily observed in FIG. 3 at lower magnification, where fiber bias in regions 14 extends between pileated regions.

Figure 4:
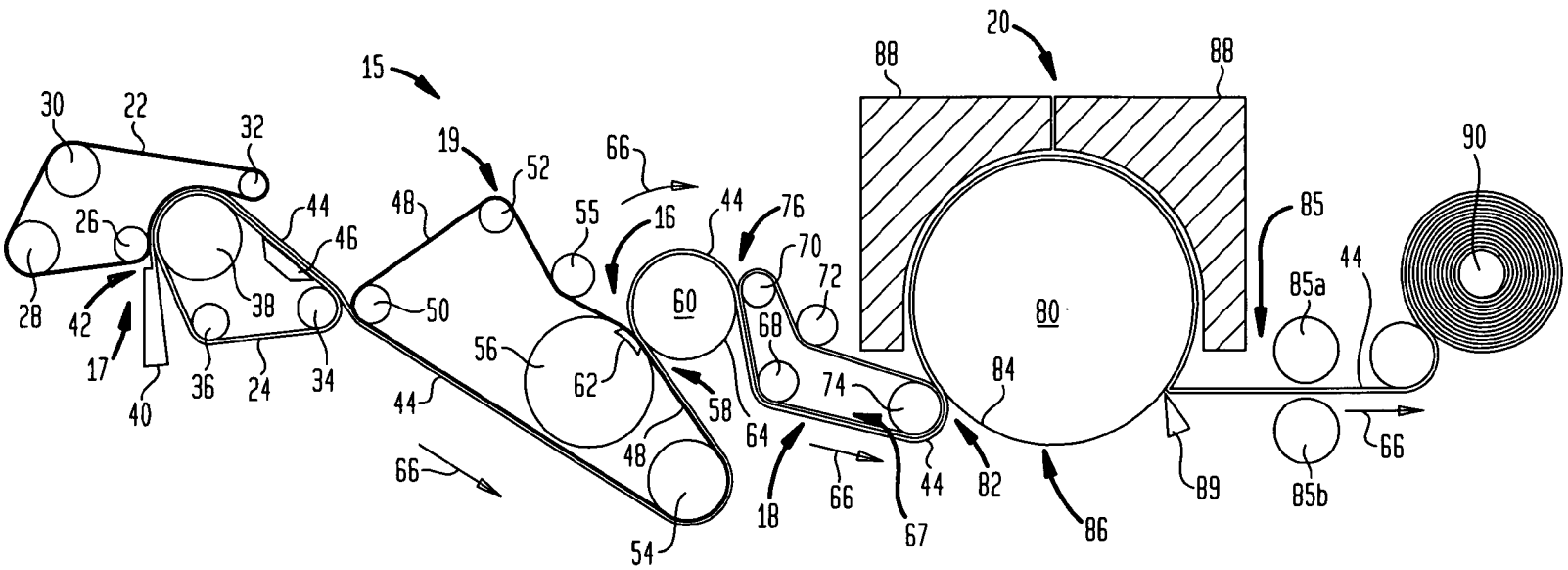
FIG. 4 is a schematic diagram illustrating a paper machine which may be used to produce the products and practice the process of the present invention.
Figure 5:
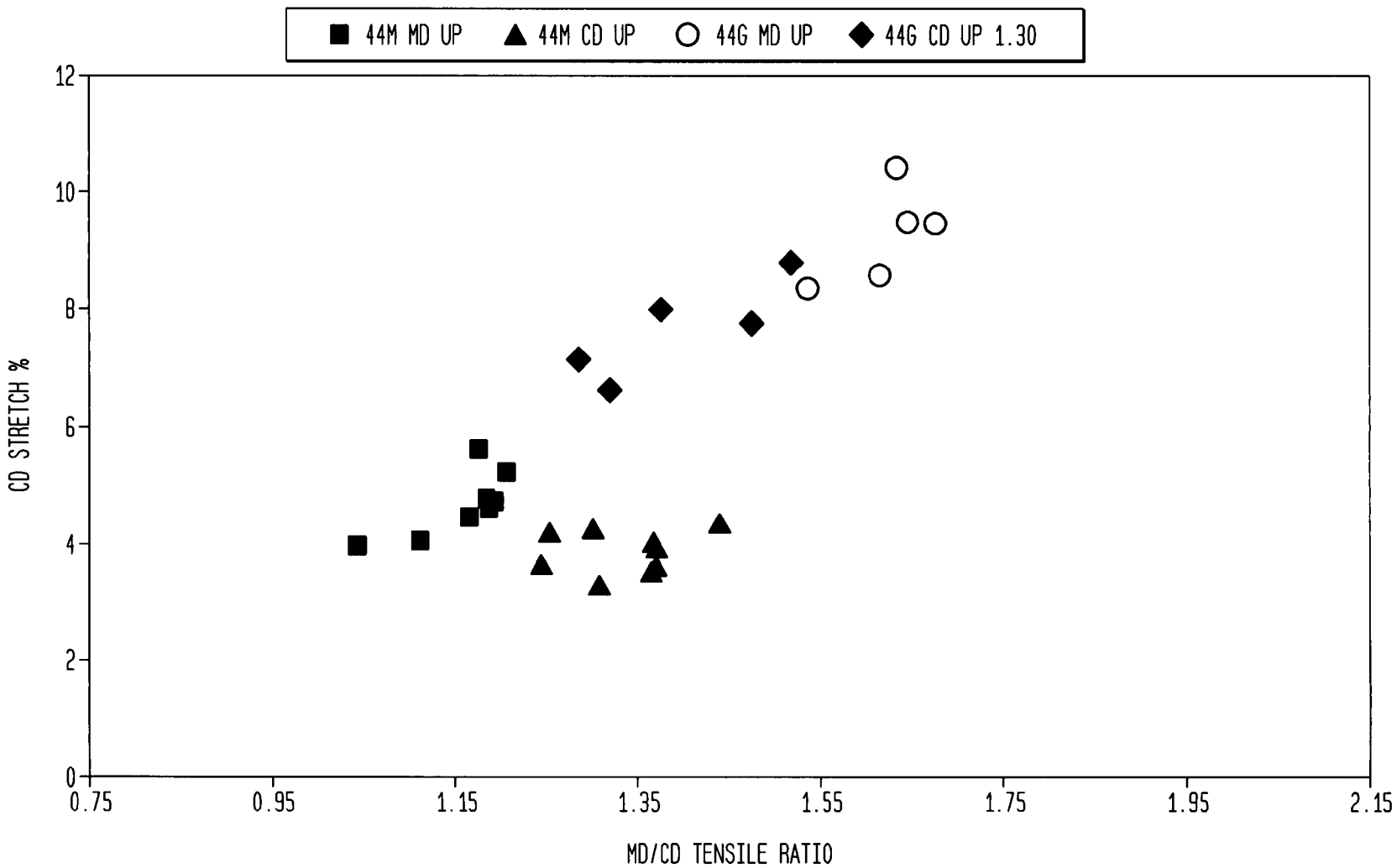
FIGS. 5 and 6 are plots of CD stretch versus MD/CD tensile ratio for 13 lb sheet produced with various fabrics and crepe ratios.
Figure 6:
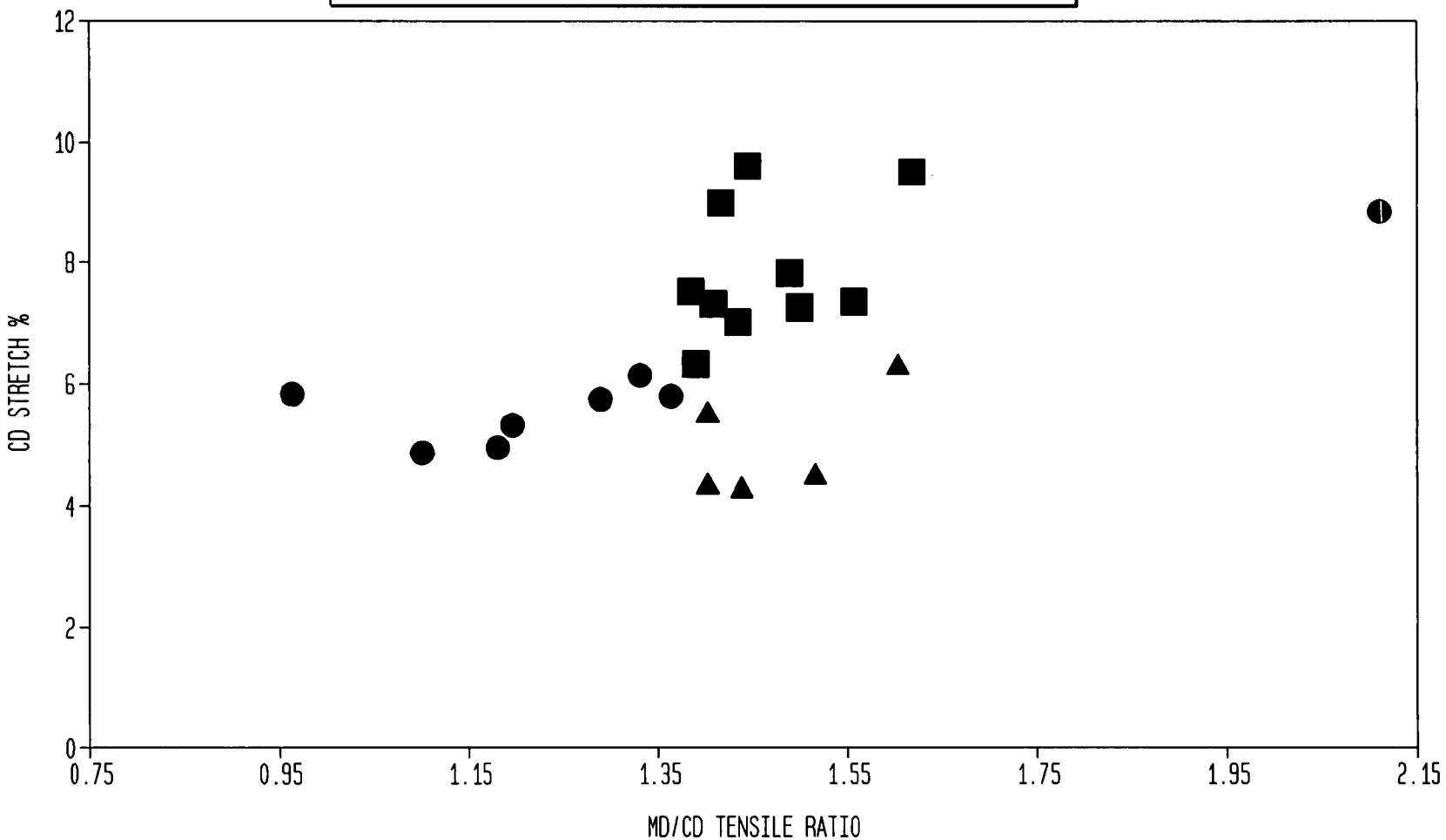
Figure 7:
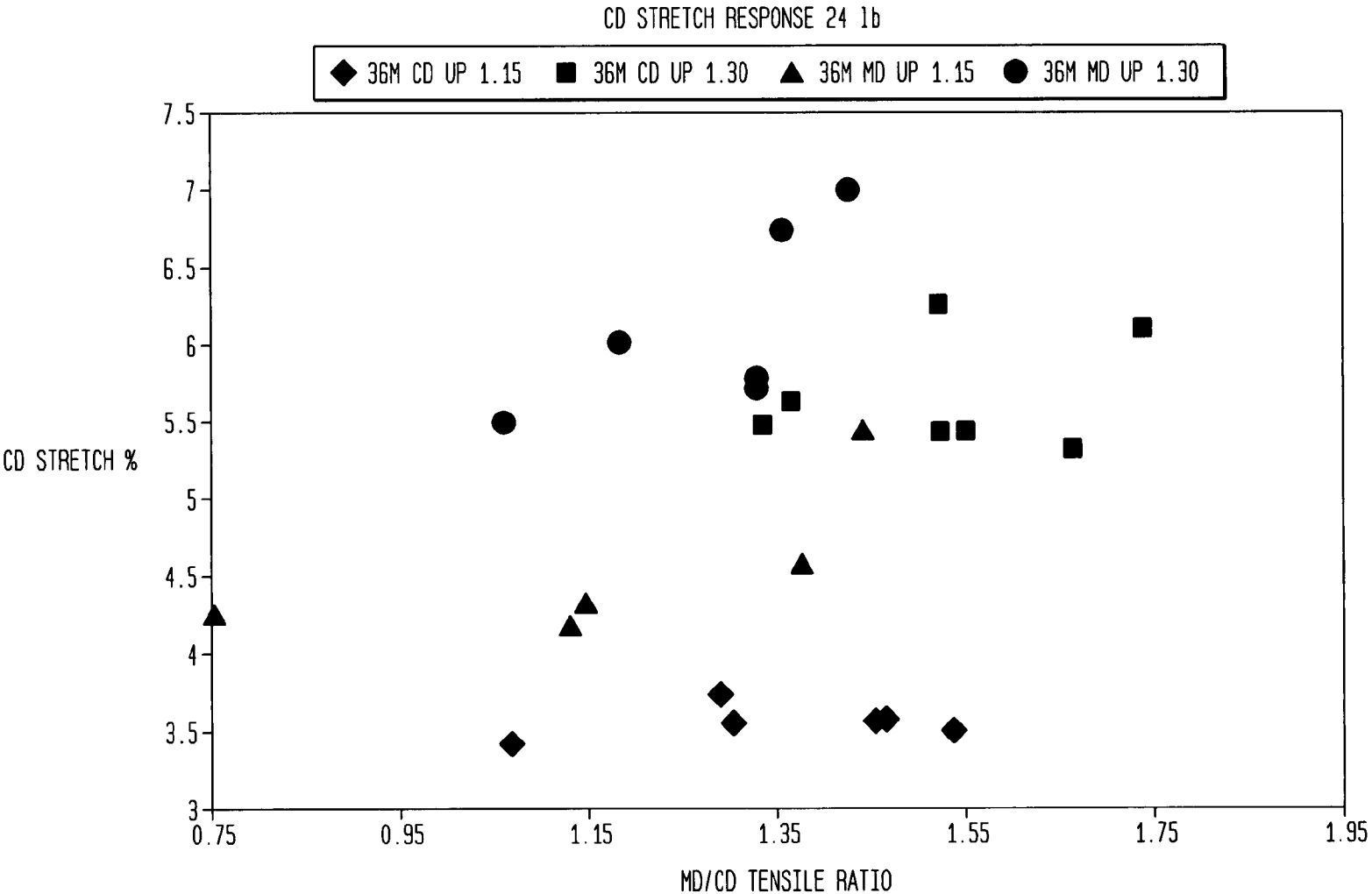
FIGS. 7 through 9 are plots of CD stretch versus dry tensile ratio for various 24 lb sheets of the invention.
Figure 8:
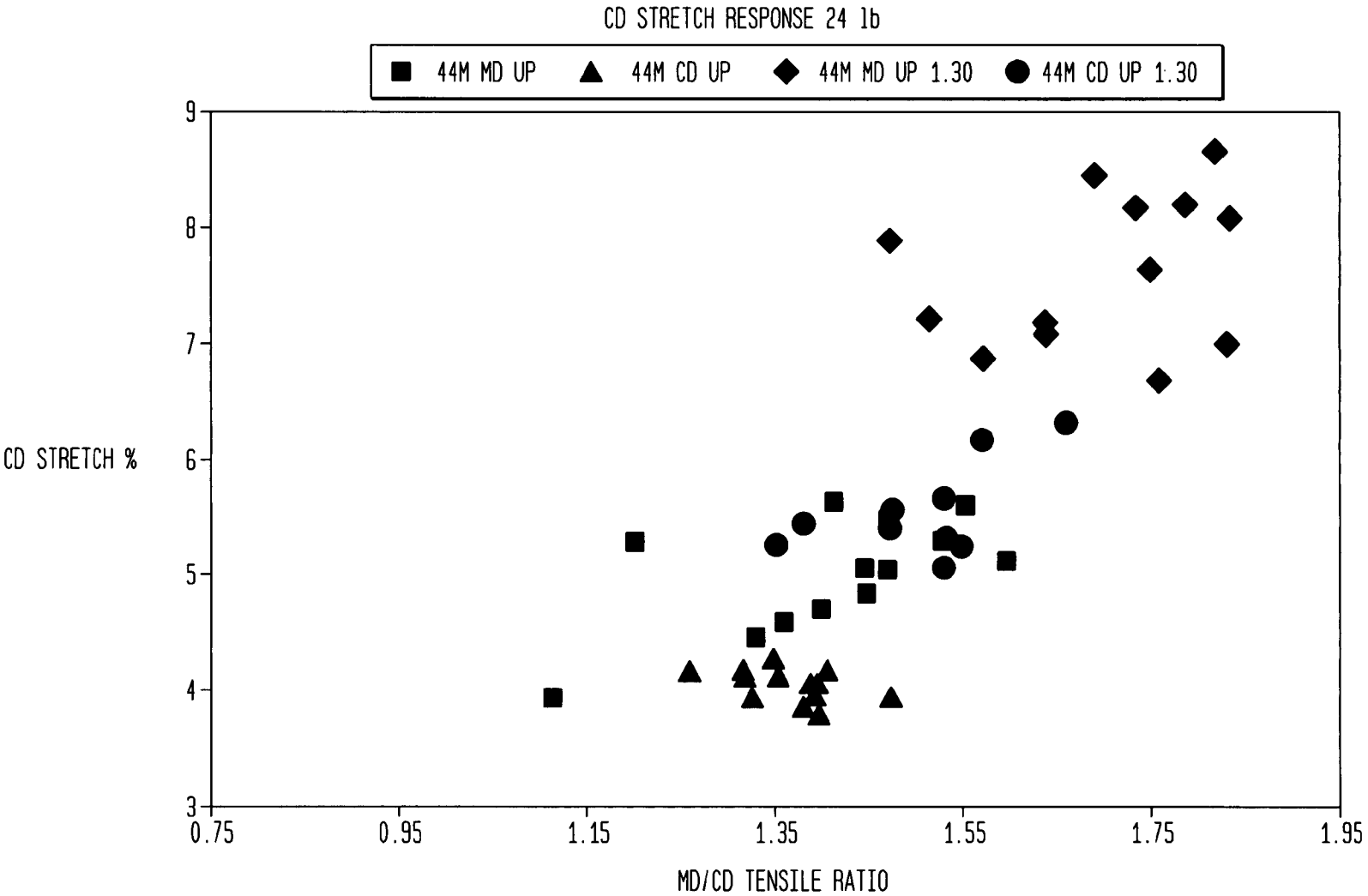
Figure 9:
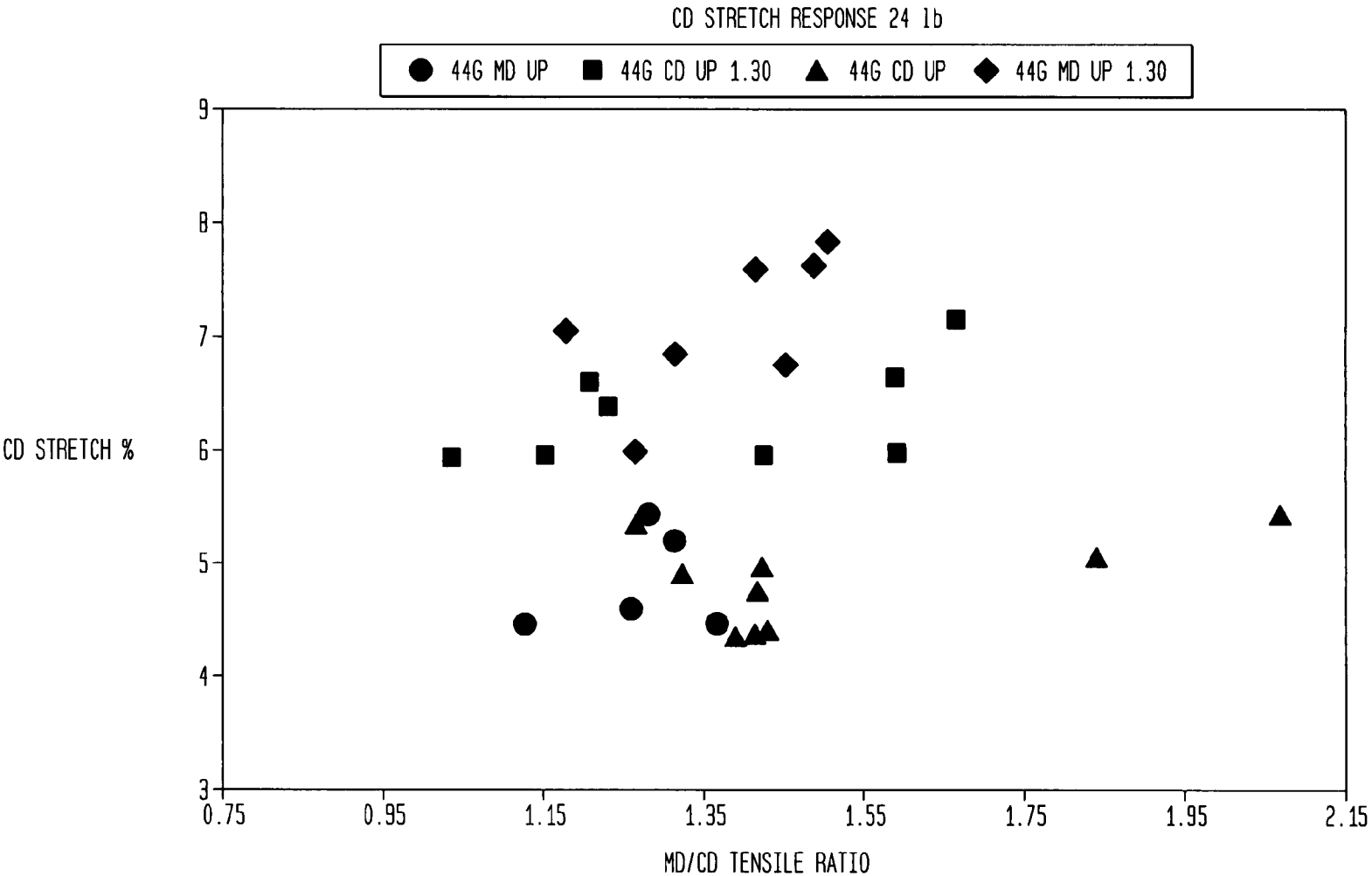
Figure 10:
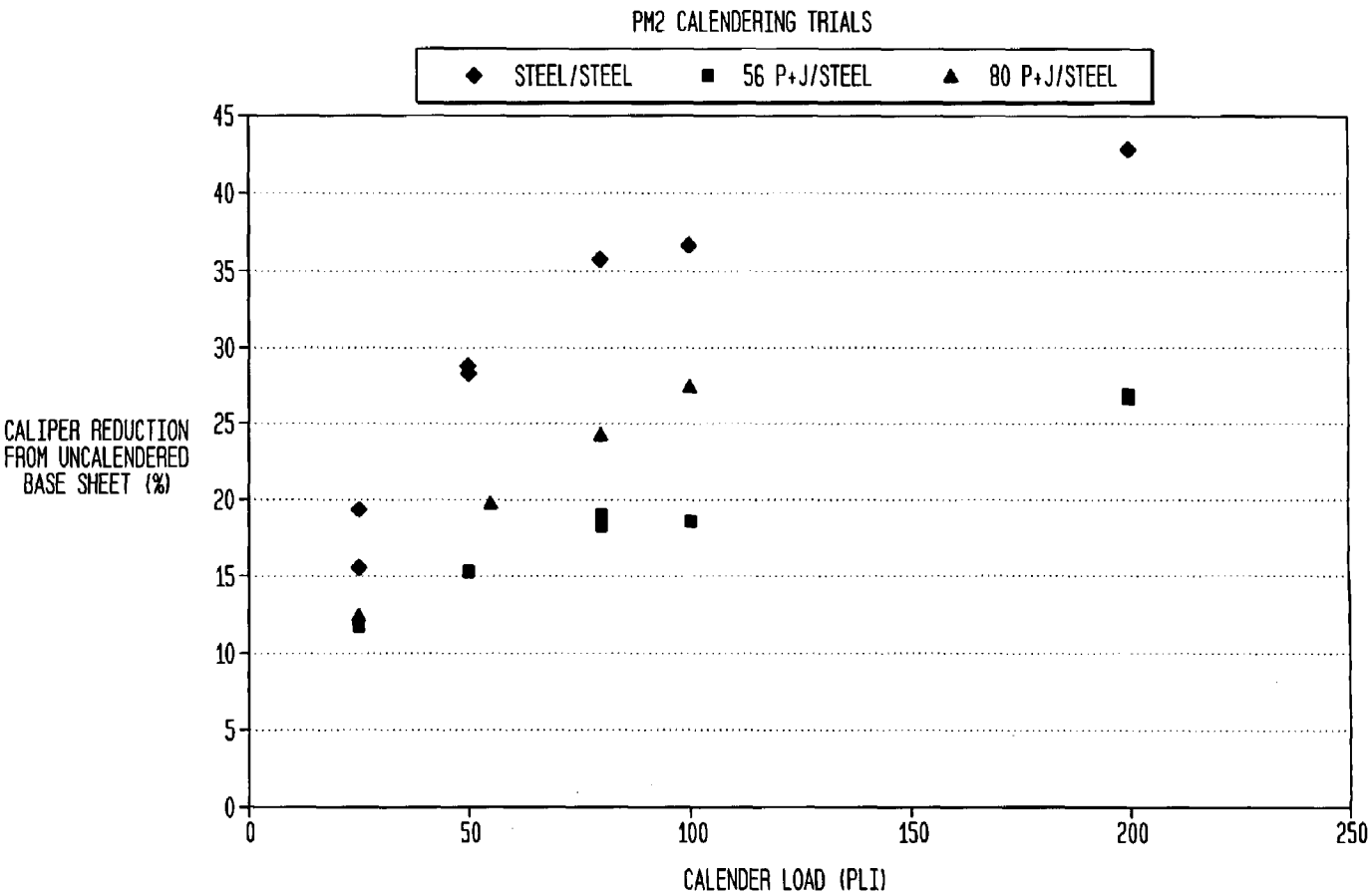
FIG. 10 is a plot of caliper reduction versus calender load for various combinations of steel and rubber calender rolls.

FIG. 4 is a schematic diagram of a papermachine 15 having a conventional twin wire forming section 17, a felt run 19, a shoe press section 16, a creping fabric 18 and a Yankee dryer 20 suitable for practicing the present invention. Forming section 12 includes a pair of forming fabrics 22, 24 supported by a plurality of rolls 26, 28, 30, 32, 34, 36 and a forming roll 38. A headbox 40 provides papermaking furnish in the form of a jet to a nip 42 between forming roll 38 and roll 26 and the fabrics. Control of the jet velocity relative to the forming fabrics is an important aspect of controlling tensile ratio as will be appreciated by one of skill in the art. The furnish forms a nascent web 44 which is dewatered on the fabrics with the assistance of vacuum, for example, by way of vacuum box 46.

The nascent web is advanced to a papermaking felt 48 which is supported by a plurality of rolls 50, 52, 54, 55 and the felt is in contact with a shoe press roll 56. The web is of low consistency as it is transferred to the felt. Transfer may be assisted by vacuum; for example roll 50 may be a vacuum roll if so desired or a pickup or vacuum shoe as is known in the art. As the web reaches the shoe press roll it may have a consistency of 10-25 percent, preferably 20 to 25 percent or so as it enters nip 58 between shoe press roll 56 and transfer roll 60. Transfer roll 60 may be a heated roll if so desired. Instead of a shoe press roll, roll 56 could be a conventional suction pressure roll. If a shoe press is employed it is desirable and preferred that roll 54 is a vacuum roll effective to remove water form the felt prior to the felt entering the shoe press nip since water from the furnish will be pressed into the felt in the shoe press nip. In any case, using a vacuum roll or STR at 54 is typically desirable to ensure the web remains in contact with the felt during the direction change as one of skill in the art will appreciate from the diagram.

Web 44 is wet-pressed on the felt in nip 58 with the assistance of pressure shoe 62. The web is thus compactively dewatered at 58, typically by increasing the consistency by 15 or more points at this stage of the process. The configuration shown at 58 is generally termed a shoe press; in connection with the present invention cylinder 60 is operative as a transfer cylinder which operates to convey web 44 at high speed, typically 1000 fpm-6000 fpm to the creping fabric.

Cylinder 60 has a smooth surface 64 which may be provided with adhesive and/or release agents if needed. Web 44 is adhered to transfer surface 64 of cylinder 60 which is rotating at a high angular velocity as the web continues to advance in the machine-direction indicated by arrows 66. On the cylinder, web 44 has a generally random apparent distribution of fiber.

Direction 66 is referred to as the machine-direction (MD) of the web as well as that of papermachine 15; whereas the cross-machine-direction (CD) is the direction in the plane of the web perpendicular to the MD.

Web 44 enters nip 58 typically at consistencies of 10-25 percent or so and is dewatered and dried to consistencies of from about 25 to about 70 by the time it is transferred to creping fabric 18 as shown in the diagram.

Fabric 18 is supported on a plurality of rolls 68, 70, 72 and a press nip roll or solid pressure roll 74 such that there is formed a fabric crepe nip 76 with transfer cylinder 60 as shown in the diagram.

The creping fabric defines a creping nip over the distance in which creping fabric 18 is adapted to contact roll 60; that is, applies significant pressure to the web against the transfer cylinder. To this end, backing (or creping) roll 70 may be provided with a soft deformable surface which will increase the length of the creping nip and increase the fabric creping angle between the fabric and the sheet and the point of contact or a shoe press roll could be used as roll 70 to increase effective contact with the web in high impact fabric creping nip 76 where web 44 is transferred to fabric 18 and advanced in the machine-direction. By using different equipment at the creping nip, it is possible to adjust the fabric creping angle or the takeaway angle from the creping nip. Thus, it is possible to influence the nature and amount of redistribution of fiber, delamination/debonding which may occur at fabric creping nip 76 by adjusting these nip parameters. In some embodiments it may by desirable to restructure the z-direction inter-fiber characteristics while in other cases it may be desired to influence properties only in the plane of the web. The creping nip parameters can influence the distribution of fiber in the web in a variety of directions, including inducing changes in the z-direction as well as the MD and CD. In any case, the transfer from the transfer cylinder to the creping fabric is high impact in that the fabric is traveling slower than the web and a significant velocity change occurs. Typically, the web is creped anywhere from 10-60 percent and even higher during transfer from the transfer cylinder to the fabric.

Creping nip 76 generally extends over a fabric creping nip distance of anywhere from about ⅛" to about 2", typically ½" to 2". For a creping fabric with 32 CD strands per inch, web 44 thus will encounter anywhere from about 4 to 64 weft filaments in the nip.

The nip pressure in nip 76, that is, the loading between backing roll 70 and transfer roll 60 is suitably 20-100, preferably 40-70 pounds per linear inch (PLI).

After fabric creping, the web continues to advance along MD 66 where it is wet-pressed onto Yankee cylinder 80 in transfer nip 82. Transfer at nip 82 occurs at a web consistency of generally from about 25 to about 70 percent. At these consistencies, it is difficult to adhere the web to surface 84 of cylinder 80 firmly enough to remove the web from the fabric thoroughly. Typically, a poly(vinyl alcohol)/polyamide adhesive composition as noted above is applied at 86 as needed.

If so desired, a vacuum box may be employed at 67 in order to increase caliper. Typically, a vacuum of from about 5 to about 30 inches of Mercury is employed.

The web is dried on Yankee cylinder 80 which is a heated cylinder and by high jet velocity impingement air in Yankee hood 88. As the cylinder rotates, web 44 is creped from the cylinder by creping doctor 89 and wound on a take-up roll 90. Creping of the paper from a Yankee dryer may be carried out using an undulatory creping blade, such as that disclosed in U.S. Pat. No. 5,690,788, the disclosure of which is incorporated by reference. Use of the undulatory crepe blade has been shown to impart several advantages when used in production of tissue products. In general, tissue products creped using an undulatory blade have higher caliper (thickness), increased CD stretch, and a higher void volume than do comparable tissue products produced using conventional crepe blades. All of these changes effected by use of the undulatory blade tend to correlate with improved softness perception of the tissue products.

There is optionally provided a calender station 85 with rolls 85(*a*), 85(*b*) to calender the sheet if so desired.

When a wet-crepe process is employed, an impingement air dryer, a through-air dryer, or a plurality of can dryers can be used instead of a Yankee. Impingement air dryers are disclosed in the following patents and applications, the disclosure of which is incorporated herein by reference:

U.S. Pat. No. 5,865,955 of Ilvespaaet et al.

U.S. Pat. No. 5,968,590 of Ahonen et al.

U.S. Pat. No. 6,001,421 of Ahonen et al.

U.S. Pat. No. 6,119,362 of Sundqvist et al.

U.S. patent application Ser. No. 09/733,172, entitled Wet Crepe, Impingement-Air Dry Process for Making Absorbent Sheet, now U.S. Pat. No. 6,432,267.

A throughdrying unit as is well known in the art and described in U.S. Pat. No. 3,432,936 to Cole et al., the disclosure of which is incorporated herein by reference as is U.S. Pat. No. 5,851,353 which discloses a can-drying system.

Representative Examples

Using an apparatus of the general class of FIG. 4, absorbent sheet was prepared at various weights, crepe ratios and so forth. This material exhibited high CD stretch at low dry tensile ratios as is seen particularly in FIGS. 5 through 9. As will be appreciated from the foregoing discussion and the following examples, the relative basis weight of the fiber enriched regions and linking regions, degree of pileation, fiber orientation and geometry of the reticulum are controlled by appropriate selection of materials and fabrics, as well as controlling the fabric crepe ratio, nip parameters and jet to wire velocity delta.

Data for representative products appears in Table 1 for basesheet and Table 2 for converted sheet.

In connection with the following Tables and Examples, the following abbreviations sometimes appear:

| | |
|---|---|
| BRT | Bath tissue |
| CD, MD | Without further specification, refers to tensile strength |
| CD %, MD % | Stretch at break in the direction indicated |
| CMC | Carboxy methyl cellulose |
| CWP | Conventional Wet Press |
| FC | Fabric crepe or fabric crepe ratio |
| GM, GMT | Geometric Mean, typically tensile |
| Mod | Modulus |
| Ratio | Dry Tensile Ratio, MD/CD |
| SPR | Solid pressure roll, roll 74 seen in FIG. 4 |
| STR | Suction turning roll, roll 54 as seen in FIG. 4 |
| T | Ton |
| TAD | Through Air Dried |
| '819 | Refers to emboss pattern of U.S. Pat. No. 6,827,819 |

TABLE 1

Representative Examples 1–194 - Basesheet Data

| Example | Basis Weight lb/3000 ft^2 | Caliper 8 Sheet mils/ 8 sht | Tensile MD g/3 in | Stretch MD % | Tensile CD g/3 in | Stretch CD % | Tensile GM g/3 in. | Tensile Dry Ratio % |
|---|---|---|---|---|---|---|---|---|
| 1 | 24.8 | 77.1 | 1031 | 37.1 | 587 | 7.6 | 778 | 1.75 |
| 2 | 25.4 | 76.4 | 1107 | 37.2 | 621 | 7.0 | 829 | 1.78 |
| 3 | 24.6 | 77.9 | 948 | 37.3 | 539 | 7.4 | 715 | 1.76 |
| 4 | 25.6 | 75.9 | 1080 | 36.0 | 580 | 7.0 | 791 | 1.86 |
| 5 | 24.9 | 79.6 | 967 | 37.0 | 521 | 7.4 | 709 | 1.86 |
| 6 | 25.0 | 76.0 | 814 | 28.9 | 487 | 5.2 | 628 | 1.67 |
| 7 | 12.3 | 58.3 | 725 | 33.4 | 288 | 8.3 | 456 | 2.52 |
| 8 | 12.6 | 59.2 | 861 | 33.3 | 281 | 9.8 | 491 | 3.07 |
| 9 | 12.4 | 57.5 | 790 | 32.9 | 297 | 9.9 | 484 | 2.66 |
| 10 | 12.2 | 56.1 | 857 | 31.7 | 289 | 9.3 | 497 | 2.97 |
| 11 | 12.5 | 65.7 | 561 | 55.9 | 291 | 10.4 | 404 | 1.93 |
| 12 | 12.2 | 66.9 | 576 | 59.4 | 218 | 12.8 | 355 | 2.64 |
| 13 | 12.2 | 68.0 | 771 | 54.9 | 240 | 14.8 | 430 | 3.22 |
| 14 | 12.1 | 68.3 | 697 | 55.4 | 217 | 15.8 | 389 | 3.21 |
| 15 | 20.0 | 74.0 | 768 | 62.3 | 484 | 10.4 | 610 | 1.59 |
| 16 | 21.2 | 68.8 | 785 | 58.1 | 561 | 6.6 | 664 | 1.40 |
| 17 | 12.2 | 57.6 | 777 | 33.1 | 252 | 10.0 | 443 | 3.08 |
| 18 | 12.4 | 58.6 | 787 | 31.8 | 273 | 7.6 | 464 | 2.88 |
| 19 | 11.8 | 54.6 | 642 | 29.9 | 228 | 8.8 | 383 | 2.81 |
| 20 | 12.2 | 57.3 | 678 | 33.0 | 231 | 8.6 | 396 | 2.93 |
| 21 | 12.6 | 59.9 | 700 | 33.7 | 251 | 8.7 | 419 | 2.79 |
| 22 | 12.6 | 59.6 | 675 | 34.0 | 224 | 7.6 | 389 | 3.01 |
| 23 | 12.5 | 56.9 | 755 | 33.6 | 263 | 8.3 | 445 | 2.88 |
| 24 | 11.9 | 56.8 | 724 | 31.1 | 262 | 7.4 | 435 | 2.76 |
| 25 | 12.0 | 55.2 | 770 | 32.5 | 252 | 7.4 | 440 | 3.06 |
| 26 | 25.0 | 76.6 | 1245 | 46.6 | 769 | 7.0 | 979 | 1.62 |
| 27 | 24.4 | 67.7 | 1105 | 45.4 | 761 | 6.5 | 916 | 1.45 |
| 28 | 24.3 | 65.3 | 911 | 44.4 | 818 | 5.4 | 863 | 1.11 |
| 29 | 24.5 | 65.6 | 888 | 44.5 | 770 | 5.3 | 827 | 1.15 |
| 30 | 21.1 | 77.5 | 464 | 43.4 | 370 | 6.2 | 414 | 1.25 |

TABLE 1-continued

Representative Examples 1–194 - Basesheet Data

| Example | Basis Weight lb/3000 ft^2 | Caliper 8 Sheet mils/ 8 sht | Tensile MD g/3 in | Stretch MD % | Tensile CD g/3 in | Stretch CD % | Tensile GM g/3 in. | Tensile Dry Ratio % |
|---|---|---|---|---|---|---|---|---|
| 31 | 20.9 | 71.1 | 494 | 41.6 | 378 | 5.7 | 432 | 1.30 |
| 32 | 21.0 | 67.1 | 660 | 43.4 | 491 | 5.3 | 569 | 1.35 |
| 33 | 20.7 | 64.4 | 625 | 41.4 | 520 | 4.9 | 569 | 1.20 |
| 34 | 20.9 | 64.4 | 695 | 42.4 | 557 | 5.0 | 622 | 1.25 |
| 35 | 21.8 | 88.5 | 728 | 48.5 | 617 | 4.8 | 670 | 1.18 |
| 36 | 21.4 | 65.7 | 1012 | 48.8 | 806 | 6.5 | 903 | 1.26 |
| 37 | 20.8 | 77.6 | 673 | 47.9 | 605 | 6.0 | 638 | 1.11 |
| 38 | 20.6 | 75.7 | 682 | 46.7 | 701 | 5.5 | 691 | 0.97 |
| 39 | 20.6 | 64.2 | 722 | 44.2 | 699 | 5.5 | 710 | 1.03 |
| 40 | 20.8 | 64.8 | 726 | 44.0 | 684 | 5.1 | 705 | 1.06 |
| 41 | 21.2 | 65.4 | 829 | 45.8 | 804 | 5.4 | 816 | 1.03 |
| 42 | 21.2 | 70.2 | 780 | 49.3 | 729 | 5.8 | 754 | 1.07 |
| 43 | 21.0 | 68.8 | 790 | 46.6 | 743 | 5.7 | 765 | 1.06 |
| 44 | 21.6 | 72.9 | 793 | 52.0 | 770 | 6.1 | 781 | 1.03 |
| 45 | 19.9 | 70.7 | 519 | 53.9 | 579 | 6.8 | 548 | 0.90 |
| 46 | 22.4 | 74.5 | 746 | 57.2 | 773 | 6.4 | 759 | 0.96 |
| 47 | 21.7 | 68.3 | 664 | 54.3 | 702 | 6.7 | 683 | 0.95 |
| 48 | 23.8 | 75.2 | 573 | 71.9 | 621 | 7.6 | 596 | 0.92 |
| 49 | 24.0 | 74.0 | 583 | 46.1 | 646 | 5.5 | 613 | 0.90 |
| 50 | 23.0 | 71.9 | 543 | 44.4 | 557 | 5.4 | 550 | 0.98 |
| 51 | 23.5 | 69.2 | 679 | 53.4 | 612 | 6.2 | 644 | 1.11 |
| 52 | 23.6 | 73.0 | 551 | 44.6 | 571 | 6.1 | 561 | 0.96 |
| 53 | 23.6 | 70.0 | 603 | 47.0 | 737 | 5.6 | 666 | 0.82 |
| 54 | 23.3 | 73.4 | 510 | 59.3 | 617 | 6.0 | 561 | 0.83 |
| 55 | 24.5 | 74.0 | 545 | 62.3 | 682 | 6.8 | 608 | 0.80 |
| 56 | 24.2 | 72.6 | 569 | 68.4 | 676 | 6.4 | 620 | 0.84 |
| 57 | 24.0 | 70.9 | 499 | 59.7 | 610 | 8.4 | 552 | 0.82 |
| 58 | 24.2 | 79.5 | 651 | 66.3 | 723 | 6.1 | 686 | 0.90 |
| 59 | 24.0 | 63.9 | 528 | 58.0 | 670 | 6.5 | 595 | 0.79 |
| 60 | 23.0 | 63.9 | 509 | 57.2 | 598 | 7.7 | 552 | 0.85 |
| 61 | 23.7 | 67.6 | 525 | 53.8 | 726 | 7.4 | 617 | 0.72 |
| 62 | 23.7 | 97.2 | 657 | 50.1 | 785 | 5.3 | 718 | 0.83 |
| 63 | 24.3 | 65.6 | 702 | 43.3 | 712 | 4.5 | 706 | 0.99 |
| 64 | 22.8 | 55.2 | 578 | 37.6 | 757 | 5.2 | 661 | 0.76 |
| 65 | 23.1 | 51.2 | 592 | 33.1 | 813 | 5.0 | 694 | 0.73 |
| 66 | 23.0 | 68.1 | 544 | 59.7 | 549 | 7.7 | 546 | 0.99 |
| 67 | 24.3 | 65.0 | 819 | 40.3 | 671 | 7.5 | 741 | 1.22 |
| 68 | 23.0 | 60.7 | 614 | 37.5 | 667 | 5.8 | 639 | 0.92 |
| 69 | 23.4 | 61.4 | 795 | 40.0 | 836 | 5.8 | 814 | 0.95 |
| 70 | 23.4 | 60.3 | 753 | 38.4 | 789 | 5.7 | 771 | 0.95 |
| 71 | 24.3 | 87.6 | 737 | 45.8 | 833 | 6.1 | 784 | 0.88 |
| 72 | 22.9 | 59.8 | 586 | 36.6 | 614 | 5.7 | 600 | 0.95 |
| 73 | 25.4 | 57.3 | 978 | 34.9 | 1043 | 5.4 | 1009 | 0.94 |
| 74 | 23.9 | 62.6 | 497 | 34.1 | 528 | 5.4 | 512 | 0.94 |
| 75 | 23.5 | 64.9 | 554 | 34.9 | 394 | 9.7 | 466 | 1.41 |
| 76 | 23.3 | 63.6 | 506 | 37.9 | 644 | 5.7 | 570 | 0.79 |
| 77 | 21.9 | 60.6 | 543 | 36.1 | 629 | 5.5 | 585 | 0.86 |
| 78 | 21.9 | 62.2 | 538 | 37.4 | 629 | 5.6 | 581 | 0.85 |
| 79 | 21.5 | 51.1 | 527 | 32.7 | 610 | 5.1 | 566 | 0.87 |
| 80 | 21.7 | 61.5 | 505 | 34.4 | 610 | 5.8 | 555 | 0.83 |
| 81 | 21.1 | 52.6 | 441 | 27.5 | 576 | 5.2 | 504 | 0.77 |
| 82 | 21.9 | 63.3 | 416 | 33.3 | 493 | 5.4 | 453 | 0.85 |
| 83 | 21.5 | 53.8 | 412 | 27.1 | 463 | 5.4 | 437 | 0.89 |
| 84 | 21.5 | 53.7 | 505 | 35.5 | 476 | 7.7 | 490 | 1.06 |
| 85 | 21.6 | 64.7 | 552 | 41.1 | 525 | 7.9 | 538 | 1.05 |
| 86 | 21.5 | 63.2 | 587 | 43.9 | 746 | 6.5 | 661 | 0.79 |
| 87 | 21.5 | 50.5 | 571 | 38.2 | 715 | 6.1 | 638 | 0.80 |
| 88 | 21.8 | 59.6 | 456 | 34.2 | 528 | 5.8 | 490 | 0.87 |
| 89 | 21.6 | 58.7 | 539 | 35.3 | 639 | 5.8 | 587 | 0.84 |
| 90 | 21.6 | 60.6 | 612 | 36.9 | 395 | 7.9 | 492 | 1.55 |
| 91 | 21.7 | 58.5 | 991 | 41.0 | 568 | 7.2 | 750 | 1.75 |
| 92 | 22.2 | 56.4 | 811 | 37.0 | 1051 | 5.0 | 923 | 0.77 |
| 93 | 22.9 | 84.6 | 1199 | 54.9 | 1318 | 5.6 | 1257 | 0.91 |
| | — | — | — | — | — | — | — | — |
| 94 | 22.3 | 91.2 | 976 | 52.2 | 1205 | 5.8 | 1084 | 0.81 |
| 95 | 22.8 | 85.2 | 1236 | 53.7 | 1481 | 5.6 | 1353 | 0.83 |
| 96 | 22.9 | 84.7 | 1303 | 57.5 | 1553 | 5.9 | 1421 | 0.84 |
| 97 | 22.6 | 66.6 | 567 | 80.9 | 676 | 8.5 | 619 | 0.84 |
| 98 | 22.3 | 66.1 | 423 | 72.5 | 624 | 9.2 | 513 | 0.68 |
| 99 | 21.9 | 63.1 | 455 | 73.1 | 514 | 9.7 | 483 | 0.89 |
| 100 | 22.3 | 67.1 | 538 | 72.5 | 590 | 9.2 | 563 | 0.91 |
| 101 | 22.1 | 65.3 | 1141 | 48.0 | 769 | 7.6 | 937 | 1.48 |

TABLE 1-continued

Representative Examples 1–194 - Basesheet Data

| Example | Basis Weight lb/3000 ft^2 | Caliper 8 Sheet mils/ 8 sht | Tensile MD g/3 in | Stretch MD % | Tensile CD g/3 in | Stretch CD % | Tensile GM g/3 in. | Tensile Dry Ratio % |
|---|---|---|---|---|---|---|---|---|
| 102 | 22.1 | 66.3 | 851 | 47.2 | 638 | 7.9 | 735 | 1.34 |
| 103 | 22.1 | 64.5 | 780 | 45.6 | 568 | 7.4 | 665 | 1.37 |
| 104 | 21.9 | 63.2 | 678 | 43.2 | 630 | 6.0 | 653 | 1.08 |
| 105 | 21.9 | 64.5 | 547 | 48.3 | 680 | 7.0 | 610 | 0.80 |
| 106 | 21.9 | 65.4 | 582 | 51.0 | 711 | 6.9 | 643 | 0.82 |
| 107 | 21.6 | 66.5 | 603 | 51.9 | 466 | 9.0 | 530 | 1.29 |
| 108 | 21.9 | 64.6 | 457 | 48.3 | 591 | 6.7 | 520 | 0.77 |
| 109 | 16.7 | 48.0 | 2146 | 26.3 | 904 | 6.3 | 1393 | 2.37 |
| 110 | 17.1 | 52.1 | 2103 | 27.1 | 831 | 5.9 | 1322 | 2.53 |
| 111 | 21.1 | 65.0 | 692 | 46.6 | 596 | 6.6 | 642 | 1.16 |
| 112 | 22.0 | 57.1 | 2233 | 50.7 | 1658 | 6.9 | 1924 | 1.35 |
| 113 | 21.0 | 62.7 | 1452 | 70.4 | 776 | 11.9 | 1061 | 1.87 |
| 114 | 21.6 | 63.5 | 1509 | 68.7 | 1066 | 10.7 | 1267 | 1.42 |
| 115 | 20.6 | 63.2 | 1369 | 69.2 | 948 | 10.8 | 1138 | 1.45 |
| 116 | 20.7 | 61.8 | 1434 | 70.4 | 943 | 10.1 | 1162 | 1.53 |
| 117 | 21.6 | 69.9 | 1322 | 70.5 | 964 | 10.6 | 1129 | 1.37 |
| 118 | 23.4 | 63.5 | 1673 | 50.2 | 1310 | 6.7 | 1480 | 1.28 |
| 119 | 22.6 | 63.1 | 689 | 52.3 | 589 | 7.4 | 637 | 1.17 |
| 120 | 22.7 | 57.6 | 638 | 50.7 | 532 | 8.1 | 583 | 1.20 |
| 121 | 22.7 | 54.4 | 706 | 50.6 | 568 | 7.4 | 633 | 1.24 |
| 122 | 22.4 | 55.7 | 640 | 49.2 | 583 | 7.7 | 611 | 1.10 |
| 123 | 23.1 | 57.7 | 559 | 46.4 | 513 | 7.1 | 535 | 1.09 |
| 124 | 23.0 | 57.6 | 617 | 49.0 | 488 | 7.0 | 548 | 1.27 |
| 125 | 22.9 | 57.6 | 597 | 49.2 | 478 | 7.4 | 534 | 1.25 |
| 126 | 22.7 | 56.5 | 641 | 49.2 | 599 | 6.8 | 620 | 1.07 |
| 127 | 22.7 | 59.6 | 583 | 49.4 | 519 | 7.4 | 549 | 1.13 |
| 128 | 23.0 | 58.2 | 702 | 52.7 | 586 | 7.6 | 641 | 1.20 |
| 129 | 23.5 | 59.1 | 713 | 52.3 | 579 | 7.1 | 642 | 1.23 |
| 130 | 23.3 | 58.9 | 626 | 49.3 | 560 | 7.6 | 592 | 1.12 |
| 131 | 22.7 | 58.8 | 624 | 75.1 | 587 | 10.9 | 605 | 1.06 |
| 132 | 23.0 | 59.8 | 683 | 78.7 | 572 | 11.5 | 625 | 1.19 |
| 133 | 22.8 | 56.9 | 852 | 51.7 | 695 | 6.8 | 769 | 1.23 |
| 134 | 22.9 | 55.8 | 896 | 50.9 | 709 | 6.9 | 796 | 1.27 |
| 135 | 22.9 | 56.7 | 849 | 50.5 | 607 | 6.8 | 716 | 1.42 |
| 136 | 23.5 | 57.6 | 843 | 49.4 | 702 | 6.5 | 769 | 1.20 |
| 137 | 23.2 | 55.0 | 615 | 50.5 | 684 | 5.3 | 648 | 0.90 |
| 138 | 22.9 | 58.9 | 702 | 76.5 | 533 | 10.8 | 612 | 1.32 |
| 139 | 21.2 | 50.8 | 1068 | 53.8 | 996 | 7.8 | 1031 | 1.07 |
| 140 | 20.9 | 52.0 | 993 | 39.2 | 829 | 7.6 | 906 | 1.20 |
| 141 | 20.9 | 51.4 | 1062 | 53.1 | 846 | 7.8 | 948 | 1.26 |
| 142 | 20.6 | 51.7 | 712 | 49.2 | 601 | 9.1 | 651 | 1.19 |
| 143 | 20.7 | 60.2 | 877 | 59.2 | 594 | 9.8 | 722 | 1.48 |
| 144 | 20.8 | 60.0 | 801 | 63.3 | 474 | 10.5 | 616 | 1.69 |
| 145 | 18.9 | 56.0 | 669 | 61.6 | 459 | 10.9 | 554 | 1.46 |
| 146 | 17.0 | 51.2 | 555 | 50.9 | 580 | 7.8 | 567 | 0.96 |
| 147 | 23.0 | 53.7 | 649 | 29.5 | 585 | 4.6 | 615 | 1.11 |
| 148 | 20.1 | 52.2 | 1098 | 52.0 | 1048 | 5.7 | 1072 | 1.05 |
| 149 | 20.1 | 53.6 | 517 | 45.4 | 472 | 6.1 | 494 | 1.10 |
| 150 | 20.4 | 55.4 | 601 | 43.2 | 500 | 5.4 | 548 | 1.20 |
| 151 | 20.4 | 52.8 | 864 | 33.6 | 600 | 5.0 | 720 | 1.44 |
| 152 | 20.5 | 55.0 | 798 | 32.5 | 745 | 4.6 | 771 | 1.07 |
| 153 | 20.6 | 58.5 | 712 | 38.1 | 636 | 5.4 | 673 | 1.12 |
| 154 | 20.6 | 60.5 | 725 | 39.3 | 635 | 5.3 | 678 | 1.14 |
| 155 | 20.6 | 61.2 | 680 | 40.1 | 592 | 5.4 | 634 | 1.15 |
| 156 | 20.5 | 60.5 | 725 | 36.4 | 648 | 5.2 | 685 | 1.12 |
| 157 | 20.3 | 60.0 | 635 | 35.9 | 610 | 5.3 | 620 | 1.05 |
| 158 | 20.4 | 58.7 | 713 | 37.5 | 604 | 5.7 | 655 | 1.18 |
| 159 | 20.5 | 61.1 | 743 | 36.7 | 651 | 5.6 | 695 | 1.14 |
| 160 | 19.8 | 60.0 | 691 | 40.7 | 611 | 4.9 | 650 | 1.13 |
| 161 | 19.7 | 59.0 | 761 | 40.9 | 682 | 4.9 | 720 | 1.12 |
| 162 | 20.2 | 60.4 | 729 | 39.2 | 678 | 5.0 | 702 | 1.08 |
| 163 | 20.0 | 60.3 | 781 | 40.6 | 665 | 5.1 | 720 | 1.17 |
| 164 | 20.1 | 58.1 | 708 | 36.3 | 645 | 5.3 | 676 | 1.10 |
| 165 | 20.0 | 56.8 | 760 | 36.7 | 663 | 4.9 | 709 | 1.15 |
| 166 | 19.9 | 57.2 | 684 | 39.3 | 610 | 5.8 | 645 | 1.12 |
| 167 | 21.0 | 63.8 | 810 | 48.0 | 885 | 6.2 | 846 | 0.91 |
| 168 | 20.8 | 66.5 | 758 | 54.1 | 656 | 7.3 | 705 | 1.15 |
| 169 | 21.0 | 66.1 | 696 | 53.0 | 619 | 7.5 | 656 | 1.12 |
| 170 | 20.9 | 66.2 | 637 | 52.6 | 540 | 7.6 | 586 | 1.18 |
| 171 | 21.3 | 63.6 | 641 | 30.1 | 531 | 4.4 | 583 | 1.21 |
| 172 | 21.4 | 78.7 | 580 | 30.8 | 486 | 4.3 | 530 | 1.20 |
| 173 | 21.0 | 65.8 | 570 | 21.4 | 479 | 4.1 | 521 | 1.20 |

TABLE 1-continued

Representative Examples 1–194 - Basesheet Data

| Example | Basis Weight lb/3000 ft^2 | Caliper 8 Sheet mils/ 8 sht | Tensile MD g/3 in | Stretch MD % | Tensile CD g/3 in | Stretch CD % | Tensile GM g/3 in. | Tensile Dry Ratio % |
|---|---|---|---|---|---|---|---|---|
| 174 | 20.8 | 71.5 | 978 | 52.5 | 859 | 6.5 | 916 | 1.14 |
| 175 | 20.0 | 57.0 | 714 | 41.5 | 644 | 5.2 | 678 | 1.11 |
| 176 | 20.4 | 65.6 | 560 | 41.2 | 746 | 4.7 | 647 | 0.75 |
| 177 | 20.2 | 67.7 | 489 | 41.6 | 648 | 4.7 | 563 | 0.76 |
| 178 | 20.4 | 67.1 | 543 | 39.6 | 662 | 4.6 | 599 | 0.82 |
| 179 | 20.2 | 67.9 | 500 | 39.7 | 646 | 4.6 | 568 | 0.77 |
| 180 | 20.4 | 69.5 | 497 | 39.5 | 650 | 4.8 | 568 | 0.76 |
| 181 | 19.8 | 66.2 | 476 | 38.5 | 602 | 4.4 | 535 | 0.79 |
| 182 | 20.5 | 68.8 | 682 | 42.3 | 665 | 5.4 | 673 | 1.03 |
| 183 | 20.3 | 71.0 | 672 | 41.1 | 668 | 5.7 | 670 | 1.01 |
| 184 | 20.2 | 69.8 | 672 | 42.1 | 613 | 5.3 | 641 | 1.10 |
| 185 | 21.0 | 72.4 | 693 | 42.1 | 670 | 5.9 | 681 | 1.03 |
| 186 | 21.0 | 73.2 | 801 | 43.2 | 752 | 5.6 | 776 | 1.07 |
| 187 | 20.6 | 70.0 | 774 | 43.3 | 746 | 5.9 | 759 | 1.04 |
| 188 | 20.5 | 76.6 | 670 | 60.7 | 644 | 6.9 | 657 | 1.04 |
| 189 | 20.3 | 74.2 | 649 | 57.1 | 671 | 7.0 | 660 | 0.97 |
| 190 | 20.3 | 77.6 | 765 | 58.6 | 719 | 7.5 | 740 | 1.07 |
| 191 | 20.3 | 78.9 | 764 | 62.5 | 710 | 7.5 | 736 | 1.08 |
| 192 | 20.5 | 78.8 | 776 | 62.7 | 696 | 7.5 | 735 | 1.12 |
| 193 | 20.6 | 78.9 | 889 | 64.5 | 776 | 7.8 | 830 | 1.15 |
| 194 | 20.7 | 67.4 | 1368 | 43.5 | 1305 | 5.2 | 1335 | 1.05 |

TABLE 2

Representative Examples 195–272 - Finished Product Data

| Example | Emboss | Sensory Softness | Softness at 450 GMT | BW | Caliper | MD | CD | GMT | MD % | CD % | MDBr Mod | CDBr Mod | GMBr Mod | MD/ CD |
|---|---|---|---|---|---|---|---|---|---|---|---|---|---|---|
| 195 | none | 15.6 | 15.9 | 20.3 | 58.8 | 578 | 478 | 526 | 32.9 | 4.3 | 17.6 | 112.1 | 44.4 | 1.21 |
| 196 | '819 | 16.3 | 16.2 | 18.7 | 70.9 | 509 | 346 | 420 | 25.4 | 6.1 | 20.0 | 57.1 | 33.8 | 1.47 |
| 197 | none | 15.3 | 15.6 | 22.3 | 68.2 | 561 | 556 | 559 | 53.9 | 6.9 | 10.4 | 81.5 | 29.1 | 1.01 |
| 198 | '819 | 15.9 | 16.0 | 21.2 | 75.1 | 504 | 495 | 499 | 46.0 | 7.7 | 10.9 | 64.6 | 26.6 | 1.02 |
| 199 | none | 15.6 | 16.2 | 23.6 | 65.8 | 613 | 596 | 604 | 34.6 | 4.9 | 17.7 | 123.9 | 46.8 | 1.03 |
| 200 | '819 | 16.3 | 16.1 | 20.9 | 72.6 | 450 | 354 | 399 | 23.0 | 5.4 | 19.6 | 65.1 | 35.7 | 1.27 |
| 201 | none | 15.4 | 16.0 | 22.2 | 62.9 | 614 | 618 | 616 | 36.0 | 4.9 | 17.1 | 125.7 | 46.3 | 0.99 |
| 202 | '819 | 15.8 | 16.1 | 21.6 | 74.6 | 579 | 493 | 534 | 28.7 | 6.1 | 20.2 | 81.1 | 40.4 | 1.17 |
| 203 | none | 15.9 | 16.1 | 22.9 | 65.7 | 505 | 503 | 504 | 30.3 | 5.3 | 16.6 | 96.0 | 39.9 | 1.00 |
| 204 | '819 | 16.3 | 16.2 | 21.8 | 78.7 | 468 | 400 | 432 | 24.6 | 6.4 | 19.0 | 62.8 | 34.5 | 1.17 |
| 205 | none | 15.5 | 16.2 | 23.0 | 64.8 | 605 | 677 | 640 | 37.2 | 4.6 | 16.3 | 145.6 | 48.7 | 0.89 |
| 206 | '819 | 15.9 | 16.2 | 21.6 | 76.7 | 510 | 520 | 515 | 28.1 | 6.2 | 18.2 | 83.9 | 39.1 | 0.98 |
| 207 | none | 15.8 | 16.1 | 22.6 | 68.7 | 493 | 559 | 525 | 46.6 | 5.5 | 10.6 | 101.7 | 32.8 | 0.88 |
| 208 | '819 | 16.1 | 16.1 | 20.7 | 73.7 | 457 | 446 | 451 | 37.7 | 6.7 | 12.1 | 67.1 | 28.5 | 1.03 |
| 209 | none | 15.2 | 15.6 | 23.4 | 67.3 | 496 | 628 | 558 | 45.4 | 6.0 | 10.9 | 104.9 | 33.8 | 0.79 |
| 210 | '819 | 15.9 | 16.1 | 22.1 | 76.4 | 498 | 514 | 506 | 40.0 | 6.7 | 12.5 | 76.5 | 30.9 | 0.97 |
| 211 | none | 15.4 | 15.8 | 22.6 | 70.1 | 567 | 561 | 564 | 50.8 | 5.0 | 11.1 | 111.9 | 35.3 | 1.01 |
| 212 | '819 | 16.2 | 16.3 | 20.7 | 75.8 | 505 | 447 | 475 | 36.8 | 6.8 | 13.7 | 66.1 | 30.1 | 1.13 |
| 213 | none | 15.7 | 16.1 | 24.2 | 67.0 | 536 | 583 | 559 | 47.5 | 6.9 | 11.3 | 84.4 | 30.9 | 0.92 |
| 214 | '819 | 16.2 | 16.2 | 21.7 | 72.9 | 444 | 427 | 435 | 38.6 | 7.8 | 11.5 | 54.9 | 25.1 | 1.04 |
| 215 | none | 16.3 | 16.6 | 22.2 | 62.0 | 495 | 567 | 529 | 46.7 | 6.0 | 10.6 | 94.3 | 31.6 | 0.87 |
| 216 | '819 | 16.3 | 16.2 | 20.8 | 68.2 | 414 | 427 | 420 | 37.7 | 7.0 | 11.0 | 60.9 | 25.9 | 0.97 |
| 217 | none | 16.3 | 16.6 | 22.7 | 60.7 | 519 | 540 | 530 | 50.8 | 6.3 | 10.2 | 86.1 | 29.7 | 0.96 |
| 218 | '819 | 16.6 | 16.6 | 21.3 | 68.0 | 483 | 438 | 460 | 42.4 | 7.6 | 11.4 | 58.0 | 25.7 | 1.10 |
| 219 | none | 16.0 | 16.7 | 24.1 | 64.6 | 593 | 711 | 649 | 51.0 | 6.8 | 11.6 | 104.5 | 34.9 | 0.83 |
| 220 | '819 | 16.3 | 16.7 | 22.3 | 71.9 | 547 | 561 | 554 | 42.8 | 7.9 | 12.8 | 72.0 | 30.3 | 0.97 |
| 221 | none | 16.3 | 16.6 | 23.3 | 66.0 | 537 | 532 | 534 | 50.9 | 7.1 | 10.5 | 74.9 | 28.1 | 1.01 |
| 222 | '819 | 16.3 | 16.1 | 20.6 | 70.2 | 426 | 379 | 402 | 37.4 | 8.5 | 11.4 | 44.7 | 22.5 | 1.12 |
| 223 | none | 15.9 | 16.4 | 22.8 | 56.4 | 565 | 610 | 587 | 30.5 | 5.0 | 18.5 | 123.1 | 47.7 | 0.93 |
| 224 | '819 | 16.6 | 16.4 | 20.9 | 68.2 | 440 | 362 | 399 | 25.3 | 5.7 | 17.4 | 63.4 | 33.2 | 1.22 |
| 225 | '819 | 16.9 | 16.5 | 22.5 | 68.2 | 347 | 330 | 338 | 23.3 | 6.2 | 14.9 | 53.3 | 28.2 | 1.05 |
| 226 | '819 | 16.8 | 16.6 | 21.9 | 67.5 | 524 | 299 | 396 | 29.9 | 9.8 | 17.5 | 30.5 | 23.1 | 1.75 |
| 227 | '819 | 16.6 | 16.6 | 21.0 | 68.6 | 443 | 435 | 439 | 26.6 | 6.0 | 16.7 | 73.2 | 35.0 | 1.02 |
| 228 | '819 | 16.8 | 16.7 | 20.8 | 60.6 | 429 | 432 | 430 | 23.3 | 5.5 | 18.5 | 76.4 | 37.6 | 0.99 |
| 229 | '819 | 16.6 | 16.4 | 20.7 | 68.9 | 373 | 392 | 382 | 19.3 | 5.6 | 19.5 | 70.3 | 37.0 | 0.95 |
| 230 | '819 | 16.9 | 16.6 | 20.4 | 61.5 | 364 | 360 | 362 | 17.7 | 5.1 | 20.9 | 70.7 | 38.4 | 1.01 |
| 231 | '819 | 17.3 | 16.7 | 20.4 | 70.6 | 314 | 286 | 300 | 17.4 | 5.8 | 17.9 | 49.4 | 29.7 | 1.10 |
| 232 | '819 | 17.4 | 16.9 | 20.3 | 65.1 | 306 | 284 | 295 | 15.7 | 5.9 | 19.3 | 48.5 | 30.6 | 1.08 |
| 233 | '819 | 16.7 | 16.5 | 20.4 | 64.4 | 452 | 355 | 401 | 25.5 | 8.1 | 18.2 | 44.1 | 28.3 | 1.27 |
| 234 | '819 | 16.5 | 16.4 | 20.3 | 69.9 | 484 | 385 | 432 | 27.5 | 7.9 | 17.5 | 48.3 | 29.1 | 1.26 |

TABLE 2-continued

Representative Examples 195–272 - Finished Product Data

| Example | Emboss | Sensory Softness | Softness at 450 GMT | BW | Caliper | MD | CD | GMT | MD % | CD % | MDBr Mod | CDBr Mod | GMBr Mod | MD/CD |
|---|---|---|---|---|---|---|---|---|---|---|---|---|---|---|
| 235 | '819 | 16.1 | 16.2 | 20.4 | 69.1 | 488 | 497 | 492 | 27.7 | 6.8 | 17.6 | 72.2 | 35.7 | 0.98 |
| 236 | '819 | 16.3 | 16.5 | 20.7 | 65.3 | 482 | 549 | 514 | 27.3 | 6.3 | 17.9 | 86.6 | 39.4 | 0.88 |
| 237 | '819 | 18.3 | 18.0 | 20.3 | 64.7 | 403 | 325 | 362 | 22.9 | 5.7 | 17.6 | 56.8 | 31.6 | 1.24 |
| 238 | '819 | 17.7 | 17.6 | 20.2 | 65.9 | 463 | 393 | 427 | 24.4 | 5.9 | 19.0 | 67.0 | 35.7 | 1.18 |
| 239 | '819 | 18.2 | 17.9 | 20.3 | 63.3 | 494 | 278 | 371 | 25.0 | 7.8 | 19.8 | 35.9 | 26.6 | 1.78 |
| 240 | '819 | 17.9 | 18.1 | 20.4 | 68.2 | 494 | 515 | 504 | 55.8 | 8.4 | 8.9 | 61.7 | 23.4 | 0.96 |
| 241 | '819 | 17.8 | 17.8 | 20.3 | 65.4 | 467 | 424 | 445 | 50.6 | 8.7 | 9.2 | 48.8 | 21.2 | 1.10 |
| 242 | '819 | 15.7 | 16.7 | 20.9 | 68.0 | 938 | 579 | 737 | 35.0 | 7.4 | 26.8 | 78.7 | 45.9 | 1.62 |
| 243 | '819 | 16.1 | 16.5 | 20.6 | 68.9 | 709 | 456 | 569 | 32.9 | 7.6 | 21.6 | 60.0 | 35.9 | 1.55 |
| 244 | '819 | 16.8 | 16.9 | 20.1 | 67.1 | 556 | 434 | 491 | 30.6 | 6.7 | 18.2 | 65.1 | 34.4 | 1.28 |
| 245 | '819 | 16.3 | 16.2 | 20.3 | 67.0 | 471 | 345 | 403 | 37.6 | 8.7 | 12.6 | 39.8 | 22.4 | 1.37 |
| 246 | '819 | 16.4 | 16.2 | 20.4 | 67.8 | 397 | 438 | 417 | 34.1 | 7.1 | 11.7 | 61.1 | 26.7 | 0.91 |
| 247 | '819 | 16.7 | 16.7 | 21.2 | 60.9 | 525 | 422 | 471 | 34.6 | 7.5 | 15.2 | 56.3 | 29.2 | 1.24 |
| 248 | '819 | 15.8 | 16.2 | 22.0 | 60.5 | 628 | 520 | 571 | 66.4 | 11.2 | 9.4 | 47.5 | 21.1 | 1.21 |
| 249 | '819 | 16.1 | 16.4 | 22.1 | 59.4 | 636 | 458 | 540 | 62.9 | 10.8 | 10.1 | 42.0 | 20.6 | 1.39 |
| 250 | B&S, M | 17.3 | 17.0 | 19.2 | 64.3 | 479 | 295 | 376 | 33.8 | 6.1 | 14.3 | 49.6 | 26.6 | 1.62 |
| 251 | Mos.Iris | 17.5 | 17.5 | 20.0 | 59.7 | 517 | 372 | 439 | 36.7 | 6.2 | 14.1 | 59.7 | 29.0 | 1.39 |
| 252 | B&S, M | 16.6 | 16.5 | 19.8 | 67.0 | 487 | 359 | 418 | 27.0 | 5.5 | 17.7 | 65.0 | 34.3 | 1.36 |
| 253 | B&S, M | 16.9 | 16.6 | 19.1 | 65.0 | 453 | 303 | 370 | 26.0 | 5.2 | 17.4 | 58.0 | 31.6 | 1.50 |
| 254 | B&S, M | 17.0 | 17.0 | 19.4 | 69.1 | 537 | 379 | 451 | 25.6 | 5.3 | 20.8 | 73.8 | 39.2 | 1.42 |
| 255 | Mos.Iris | 17.6 | 17.7 | 19.9 | 65.1 | 571 | 398 | 477 | 28.4 | 5.4 | 20.1 | 73.8 | 38.5 | 1.43 |
| 256 | B&S, M | 17.0 | 16.9 | 19.3 | 65.8 | 507 | 347 | 419 | 25.2 | 5.4 | 20.0 | 64.3 | 35.8 | 1.46 |
| 257 | Mos.Iris | 18.1 | 18.3 | 19.5 | 65.4 | 603 | 427 | 507 | 31.9 | 5.1 | 18.9 | 83.8 | 39.8 | 1.41 |
| 258 | B&S, M | 18.0 | 18.0 | 18.7 | 67.3 | 553 | 373 | 454 | 28.9 | 4.9 | 19.1 | 76.2 | 38.1 | 1.48 |
| 259 | B&S, M | 17.9 | 18.0 | 19.0 | 69.0 | 594 | 385 | 478 | 30.0 | 5.3 | 20.8 | 74.3 | 39.0 | 1.54 |
| 260 | B&S | 17.1 | 17.0 | 19.6 | 68.1 | 521 | 334 | 417 | 30.2 | 6.5 | 17.5 | 51.9 | 30.1 | 1.56 |
| 261 | B&S | 16.3 | 16.3 | 20.5 | 76.4 | 513 | 401 | 454 | 39.0 | 8.1 | 13.1 | 49.3 | 25.4 | 1.28 |
| 262 | DH | 16.9 | 17.0 | 21.9 | 70.0 | 672 | 353 | 487 | 19.0 | 5.0 | 35.0 | 71.0 | 50.0 | 1.90 |
| 263 | B&S | 16.8 | 17.1 | 22.1 | 64.0 | 700 | 406 | 533 | 21.0 | 4.0 | 34.0 | 94.0 | 57.0 | 1.72 |
| 264 | none | 16.6 | 17.3 | 22.5 | 63.0 | 814 | 518 | 649 | 23.0 | 4.0 | 35.0 | 137.0 | 69.0 | 1.57 |
| 265 | DH | 16.6 | 17.4 | 21.8 | 68.0 | 1166 | 407 | 688 | 23.9 | 6.2 | 49.0 | 66.0 | 57.0 | 2.86 |
| 266 | DH | 17.6 | 17.7 | 17.0 | 65.0 | 583 | 413 | 491 | 31.0 | 6.0 | 19.0 | 69.0 | 36.0 | 1.41 |
| 267 | DH | 17.8 | 17.7 | 22.8 | 77.0 | 485 | 385 | 432 | 32.0 | 6.0 | 15.0 | 68.0 | 32.0 | 1.26 |
| 268 | DH | 16.4 | 16.6 | 23.0 | 85.0 | 658 | 370 | 493 | 29.0 | 6.0 | 23.0 | 58.0 | 36.0 | 1.78 |
| 269 | DH | 17.9 | 18.0 | 21.1 | 78.0 | 565 | 393 | 471 | 30.0 | 5.0 | 19.0 | 77.0 | 38.0 | 1.44 |
| 270 | DH | 17.8 | 18.3 | 21.4 | 84.0 | 792 | 431 | 584 | 31.0 | 6.0 | 25.0 | 76.0 | 44.0 | 1.84 |
| 271 | M3 | 18.6 | 18.5 | 20.8 | 104.0 | 629 | 291 | 428 | 25.0 | 7.0 | 25.0 | 41.0 | 32.0 | 2.16 |
| 272 | DH | 17.4 | 18.0 | 21.5 | 86.0 | 844 | 468 | 628 | 32.0 | 6.0 | 26.0 | 84.0 | 47.0 | 1.80 |
| 273 | B&S | 16.4 | 16.2 | 21.0 | 72.8 | 482 | 367 | 421 | 21.8 | 4.7 | 22.2 | 78.4 | 41.7 | 1.32 |
| 274 | B&S | 16.2 | 16.1 | 20.4 | 77.9 | 498 | 332 | 407 | 22.1 | 4.9 | 22.5 | 67.5 | 39.0 | 1.50 |
| 275 | B&S | 16.5 | 16.3 | 20.5 | 71.3 | 459 | 309 | 377 | 16.5 | 4.6 | 27.9 | 67.9 | 43.5 | 1.49 |
| 255 | Mos.Iris | 17.6 | 17.7 | 19.9 | 65.1 | 571 | 398 | 477 | 28.4 | 5.4 | 20.1 | 73.8 | 38.5 | 1.43 |
| 256 | B&S, M | 17.0 | 16.9 | 19.3 | 65.8 | 507 | 347 | 419 | 25.2 | 5.4 | 20.0 | 64.3 | 35.8 | 1.46 |
| 257 | Mos.Iris | 18.1 | 18.3 | 19.5 | 65.4 | 603 | 427 | 507 | 31.9 | 5.1 | 18.9 | 83.8 | 39.8 | 1.41 |
| 258 | B&S, M | 18.0 | 18.0 | 18.7 | 67.3 | 553 | 373 | 454 | 28.9 | 4.9 | 19.1 | 76.2 | 38.1 | 1.48 |
| 259 | B&S, M | 17.9 | 18.0 | 19.0 | 69.0 | 594 | 385 | 478 | 30.0 | 5.3 | 20.8 | 74.3 | 39.0 | 1.54 |
| 260 | B&S | 17.1 | 17.0 | 19.6 | 68.1 | 521 | 334 | 417 | 30.2 | 6.5 | 17.5 | 51.9 | 30.1 | 1.56 |
| 261 | B&S | 16.3 | 16.3 | 20.5 | 76.4 | 513 | 401 | 454 | 39.0 | 8.1 | 13.1 | 49.3 | 25.4 | 1.28 |
| 262 | DH | 16.9 | 17.0 | 21.9 | 70.0 | 672 | 353 | 487 | 19.0 | 5.0 | 35.0 | 71.0 | 50.0 | 1.90 |
| 263 | B&S | 16.8 | 17.1 | 22.1 | 64.0 | 700 | 406 | 533 | 21.0 | 4.0 | 34.0 | 94.0 | 57.0 | 1.72 |
| 264 | none | 16.6 | 17.3 | 22.5 | 63.0 | 814 | 518 | 649 | 23.0 | 4.0 | 35.0 | 137.0 | 69.0 | 1.57 |
| 265 | DH | 16.6 | 17.4 | 21.8 | 68.0 | 1166 | 407 | 688 | 23.9 | 6.2 | 49.0 | 66.0 | 57.0 | 2.86 |
| 266 | DH | 17.6 | 17.7 | 17.0 | 65.0 | 583 | 413 | 491 | 31.0 | 6.0 | 19.0 | 69.0 | 36.0 | 1.41 |
| 267 | DH | 17.8 | 17.7 | 22.8 | 77.0 | 485 | 385 | 432 | 32.0 | 6.0 | 15.0 | 68.0 | 32.0 | 1.26 |
| 268 | DH | 16.4 | 16.6 | 23.0 | 85.0 | 658 | 370 | 493 | 29.0 | 6.0 | 23.0 | 58.0 | 36.0 | 1.78 |
| 269 | DH | 17.9 | 18.0 | 21.1 | 78.0 | 565 | 393 | 471 | 30.0 | 5.0 | 19.0 | 77.0 | 38.0 | 1.44 |
| 270 | DH | 17.8 | 18.3 | 21.4 | 84.0 | 792 | 431 | 584 | 31.0 | 6.0 | 25.0 | 76.0 | 44.0 | 1.84 |
| 271 | M3 | 18.6 | 18.5 | 20.8 | 104.0 | 629 | 291 | 428 | 25.0 | 7.0 | 25.0 | 41.0 | 32.0 | 2.16 |
| 272 | DH | 17.4 | 18.0 | 21.5 | 86.0 | 844 | 468 | 628 | 32.0 | 6.0 | 26.0 | 84.0 | 47.0 | 1.80 |

Tissue Products

Tissue Products (non-permanent wet strength grades where softness is a key parameter) made with a high solids fabric crepe process as described herein can use many of the same process parameters as would be used to make towel products (permanent wet strength grades where absorbency is important, strength in use is critical, and softness is less important than in tissue grades.) In either category, 1-ply and 2-ply products can be made.

Fibers: Soft tissue products are optimally produced using high amounts of hardwood fibers. These fibers are not as coarse as the longer, stronger, softwood fibers. Further, these finer, shorter, fibers exhibit much higher counts per gram of fiber. On the negative side, these hardwood pulps generally contain more fines that are a result of the wood structures from which the pulp was made. Removing these fines can increase the numbers of actual fibers present in the final paper sheets. Also, removing these fines reduces the bonding potential during the drying process, making it easier to debond the sheet either with chemicals or with blade creping at the dry end of the paper machine. The key benefit derived from high fiber counts per gram of pulp is sheet opacity or lack of transparency. Since a large part of a tissue sheet's performance is judged visually even before the sheet is touched, this optical property is an important contributor to the perception of quality. Softwood fibers are usually needed to provide a mesh-like structure on which the hardwood fibers can be arranged to optimize softness and optical properties. But even in the case of softwoods, fiber coarseness and fibers per gram are important properties. Long, thin, flexible, softwood fibers like northern softwoods present many more fibers per gram than do the long, coarse, thick, stiff southern softwoods. The net result of fiber selection is that with this technology, like all others, northern softwoods and low fines, low coarseness hardwoods like eucalyptus make softer sheets at a given tensile than do northern hardwoods and more so southern hardwoods.

Chemicals: Tissue sheets generally employ a variety of chemicals to help meet consumer demands for performance and softness. Generally, it is much preferred to apply a dry strength chemical to the long fiber portion of the pulp blend than to use a refiner to develop tensile. Refining generates fines and tends to make more bonds of higher bonding strength because refining makes the fibers more flexible, which increases the potential for fiber-fiber contacts during drying. On the other hand, dry strength additives increase the strengths of the available bonds without increasing the number of bonds. Such a sheet then ends up being inherently more flexible even before the fabric creping step of the fabric crepe process. Applying a debonding chemical to the hardwood portion is desirable so that these hardwood fibers have a lower propensity of bonding to each other, but retain the capability of being bonded to the network of softwood fibers that is primarily responsible for the working tensile strengths of the paper. In some cases, a temporary wet strength agent can also be added along with the softwood and hardwood fibers to improve the perception of wet strength performance without sacrificing flush ability or septic tank safeness.

Fabric Creping: This process step is primarily responsible for the unique and desirable properties of a tissue sheet. Increased fabric creping increases caliper and decreases tensiles. Further, fabric creping changes the tensile ratios measured in the base sheets allowing sheets with equal MD/CD tensiles or sheets with lower MD than CD tensiles. However, it is desirable for tissue sheets to exhibit equal tensiles in the two directions as most products are used in a manner independent of sheet direction. For example, "poke through" in a toilet paper is influenced by this tensile ratio along with the fact that fabric creping develops higher CD stretch, especially at lower MD/CD ratios than conventional technology. With other technologies, equal tensile material is difficult to run through high speed processing equipment due to the propensity of tears initiated at an edge tend to propagate across the sheet causing a break. In contrast to conventional products, fabric creped sheets of equal tensile ratio made by way of the inventive process retain the tendency to tear along the MD direction, thereby exhibiting a tendency to self-healing should an edge tear occur and begin to propagate into the sheet. This unexpected and unique property along with the resistance of the stretch put into the sheet at this step to being pulled out allows efficient, high speed, operations at tensile ratios of one or less. Further, these same properties result in clean tears at perforations in the final products. Levels of fabric crepe for tissue products ranges from about 30 percent up to about 60 percent. While more is possible, this range allows for a wide variety of quality levels with no changes in the productivity at the paper machine.

Fabrics: The design of the fabrics is a salient aspect of the process. But the parameters of the fabric go beyond the size and depth of the depressions woven into it. Their shape and placement is also very important. Diameters of the strands making up the woven fabric are also important. For example, the size of the knuckle that stands at the leading edge of the depression into which the sheet will be creped determines the parameters of fabric crepe ratio and basis weight at which holes will appear in the sheet. The challenge, especially for tissue grades, is to make these depressions as deep as possible with finest possible strand diameters, thereby allowing greater fabric crepe ratios resulting in higher sheet calipers at a given ratio. Clearly, fabric designs need to change based upon the weight of the sheet being produced. For example, a very high quality, premium, 2-ply bathroom tissue exhibiting high strength, caliper, and softness can be made on a 44M-design fabric. The 44G can also be used to make a heavier (up to 2×) weight single ply sheet with very good results. Another property of the fabric design is to impart a pattern into the sheet. Some fabric designs can impart a very noticeable pattern while others produce a pattern that seems to disappear into the background. Often times, consumers want to see the embossing pattern put into the sheet at converting and in these instances a lesser sheet pattern might be more desirable. Some grades may be made without embossing and so a more distinct pattern imparted by the fabric creping step would help impart a "premium" look to the sheet. Consumers tend to view plain sheets as lower quality, lower priced products.

Creping: Since in a typical fabric crepe process of the invention the sheet is transferred to a Yankee dryer for final drying, the sheet can be (and usually is) creped off this dryer to further enhance the softness. Tissue products benefit greatly from this creping step that adds caliper and softness to the sheet. It especially makes for a smooth surface on the Yankee side of the sheet. Further, since the ratio of reel crepe and fabric crepe can be varied independent of production rate (reel speed) there is considerable latitude in changing the properties of the final sheet. Increasing the reel crepe/fabric crepe ratio decreases the two sidedness of the paper since less fabric crepe will be put in for a level of MD stretch. There less prominent "eyebrow" structures in the paper that can affect two-sidedness. Further, increasing that ratio also increases the opacity and the perception of thickness at the same measured caliper. Often it is desirable to maintain a reasonable ratio (say 25 to 50 percent reel crepe/fabric crepe) to enhance consumer perceptions of these "intangible" properties associated with the visual appearance of the sheet.

Calendering: By all accounts, more calendering is better insofar as a reasonable level of caliper is maintained in the sheet for subsequent converting. Too little caliper requires too much embossing which then degrades the overall quality. Therefore, one strategy for producing for quality toilet paper is use the coarsest fabric without putting holes in the sheet, reducing the fabric creping level so that more of the MD stretch will come from the reel crepe portion and still get sufficient caliper prior to calendering so that at least about 20-40% of this caliper may be removed during the calendering step. These calendering levels tend to reduce the sidedness of sheets. Alternatively, a quality sheet can be made with a finer fabric but with a lower reel crepe/fabric crepe ratio. Since the finer fabric produces more, smaller, domes, more fabric creping can be used to obtain the desired caliper without unduly increasing sidedness. In most cases, reduced sidedness is obtained. In this scenario the reel crepe/fabric crepe ratio can be as low as about 5-10%. Calendering can then be maximized to achieve the desired softness. This method is desirable when relatively strong fibers are used as the fabric creping dramatically reduces tensile strengths and when the design of the fabric produces less than average two-sidedness in the sheet.

Towel Products

Towel Products behave in a fashion similar to the tissue sheets to various process parameters. However, in many cases towel products utilize the same parameters but in an opposite direction with some in the same direction. For example, both product forms desire caliper as caliper relates directly to softness in tissue products and absorbency in towel products. In the following parameters, only the differences from tissue situations will be discussed.

Fibers: Towels require functional strength in use, which usually means when wetted. To reach these needed tensiles, long softwood fibers are used in ratios about opposite that of tissue products. Ratios of 70 to 90 percent softwood fibers are common. Refining can be used but tends to close up the sheet so much so that the subsequent fabric creping cannot "open" the structure. This results in slower absorbency rates and lower capacities. Unlike tissue products, fines can be utilized in towel sheets providing that not too much hardwood is used as this again would tend to close the sheet and also to reduce its tensile capability.

Chemicals: Surprisingly, debonders can also be used in towels! But their use must be done judiciously. Likewise, refining of the fibers needs to be regulated to lower levels to keep the sheet open and a quick absorber. Therefore chemical strength agents are routinely added. Of course wet strength chemicals must be added to prevent shredding in use. But to get to high wet tensile levels the ratio of wet to dry tensiles must be maximized. If dry tensile levels get too high the towel sheet becomes too "papery" and is judged as low quality by consumers. Therefore, wet strength agents and CMC are added to increase the CD wet/dry ratio from the typical 25% up to the desired 30-35% range. Then to produce a softer—and thus a sheet perceived by consumers as more premium—sheet debonder can be added which preferentially reduces the CD dry tensile over the wet value. Debonders and softeners can also be sprayed onto the sheet after it has dried to further improve the tactile properties.

Fabric Creping: Increasing the fabric creping increases the absorbency directly. Therefore it is desirable to maximize fabric creping. However, FC also reduces tensiles so there is the balance that must be maintained. Towel sheets sometimes cannot exhibit high levels of MD stretch because of the type of dispensers that are used. In these cases FC must also be limited. Therefore, towels require a coarser fabric design on average than do tissue sheets. Further, since these wet sheets will typically exhibit considerable wet strength, they may be more difficult to mold at the same consistency as a tissue sheet.

Fabrics: Coarse fabrics are desirable for towels in general. Two-ply towel sheets are typically made on a 44G or 36G fabric or coarser with good results, although good results can be obtained with finer fabrics, particularly if the fabric crepe ratio is increased. One-ply sheets often require an even coarser fabric along with other technology to make and acceptable sheet. The longer fibers in the sheets and the higher strengths permit the use of these fabrics and higher FC ratios before holes appear in the sheets.

Creping: Very little creping is done on towel sheets. Creping does increase caliper but does so in a manner similar to CWP sheets. This caliper disappears when wetted and the sheet expands. Caliper from fabric creping acts like a dry sponge when wetted. The sheet expands in the Z-direction and can shrink in the MD & CD directions. This behavior adds greatly to the perceived absorbency of the towels and makes them look similar to TAD towels. In many cases, using the serrated blades of Taurus technology in conjunction with fabric crepe process improves the absorbency, caliper, and softness of the towel sheet. The CD stiffness is reduced while the CD stretch is increased. The higher caliper produced at the blade allows more calendering and hence more sheet smoothness. In some cases it is desirable to pull the sheet off the Yankee dryer surface without creping. This might be the case for washroom hand towels where softness is less important than getting more sheets on a roll. See U.S. Pat. No. 6,187,137 to Druecke et al. as well as copending U.S. patent application Ser. Nos. 11/108,375 (Publication No. US 2005-0217814 A1), filed Apr. 18, 2005 and Ser. No. 11/108,458 (Publication No. US 2005-0241787 A1), filed Apr. 18, 2005, filed contemporaneously herewith.

Calendering: Towel sheets benefit from calendering for two key reasons. First, calendering smoothes the sheets and improves the tactile feel. Second, it "crushes" the domes produced by the fabrics imparting more Z-direction depth to the feel of the sheet and often improve the absorbent properties at a given caliper.

Data Summary for Tissue

Several paper machine process tools and emboss patterns were used to produce 1-ply retail and commercial bathroom tissue. Process variables included: fabric crepe percent, reel crepe percent, softener addition level, softener type, softener location, fiber type, HW/SW ratio, calendering load, rubber and steel calendering, creping fabric style, MD/CD ratio and Yankee coating chemistry. The emboss patterns included: '819, M3, Double Hearts, Butterflies and Swirls, Butterflies and Swirls with Micro and Mosaic Iris. The best commercial 1-ply bathroom tissue (BRT) prototype containing 40% Northern HW and 60% recycled fiber, at 20 lb basis weight and 450 GMT, achieved a 17.5 sensory softness. The best retail 1-ply BRT prototype containing 80% Southern HW and 20% Southern SW, at 20.5 lb basis weight and 450 GMT, achieved a 16.9 sensory softness.

The objects included determining: the process requirements that produce 1-ply retail tissue with a sensory softness of 17.0 using Southern hardwood (HW) and softwood (SW); the process requirements that produce 1-ply commercial tissue with a sensory softness of 17.0 using HW and recycled fiber and the effects of fiber and other process variables on sensory softness and physical properties.

The commercial 1-ply BRT sensory softness objective of 17.0 was achieved at 20 lb basis weight. Consumer testing will determine the effect of reduced basis weight on consumer acceptance of the product.

Using Southern HW and SW to make 1-ply retail tissue at 21.4 lb/3000 sq. ft., the highest sensory softness achieved at 450 GMT was 16.9.

Using Southern HW and SW to make 1-ply retail tissue at 20.5 lb/3000 sq. ft., the highest sensory softness achieved at 450 GMT was 16.9.

Using 40% HW and 60% recycled fiber (FRF) to make 1-ply commercial tissue at 20.2 lb/3000 sq. ft., the highest sensory softness achieved at 450 GMT was 17.5. For all work reported here, the average sensory softness was 16.9. Using 100% FRF to make 1-ply commercial tissue PS at 22.1 lb/3000 sq. ft., the highest sensory softness achieved at 450 GMT was 16.4.

Using Aracruz HW and Marathon SW to make 1-ply retail tissue at 19.8 lb/3000 sq. ft., the highest sensory softness achieved at 450 GMT was 18.3. For all work reported here, the average sensory softness was 18.0.

Steel/steel calendering resulted in higher caliper reduction at equivalent load and higher sensory softness than rubber/steel calendering.

Increasing calender load appeared to increase sensory softness, but calendering at higher than 65 PLI may decrease softness when using virgin HW and recycled fiber. For HW and SW, 80 PLI may be the upper limit.

At constant line crepe percent, an increase in fabric crepe percent resulted in an increase in CD stretch and a reduction in CD break modulus. However, finished product sensory softness was not affected at constant GMT.

At constant line crepe percent, varying the amounts of fabric crepe percent versus reel crepe percent did not affect sensory softness.

The types of creping fabrics used in this study affected basesheet caliper, but did not significantly affect sensory softness. Coarse mesh fabrics developed higher basesheet caliper and allowed for higher calendering levels.

1-ply BRT with a 1.0 MD/CD tensile ratio (MD tensile equal to CD tensile) was equivalent in sensory softness to 1-ply BRT with a traditional MD/CD ratio of 1.8 (higher MD tensile). In this case, softness was dependent on GMT not CD strength or CD modulus.

Furnish Effect

The fiber mixtures in Tables 3 and 4 were run at similar process conditions and 1-ply BRT was produced. Sensory softness was measured and adjusted to 450 GMT using the strength—softness values from data in the Appendix with the formula: (sensory softness)+((450−GMT) * (−0.0035)). The eucalyptus and Marathon SW furnish resulted in significantly higher softness than the others. The Southern HW and SW furnish is currently being used for retail 2-ply tissue. It is the furnish currently used in the development of 1-ply BRT prototypes on PM#2. Replacing the Southern SW with Marathon SW slightly improved softness (Table 3). To date, 16.9 is the best sensory softness achieved at 450 GMT (Table 4). The average for all work containing only Southern fiber is 16.4. Achieving the 17.0 sensory softness target at 450 GMT represents a significant technical challenge. The fabric crepe process of the invention produces a very low modulus sheet that is acceptable for retail or commercial BRT. However, because the sheet is attached to the Yankee with a fabric, there is less contact area on the dryer. During the Yankee creping process, less smoothing of the sheet surface occurs compared to conventional attachment to the Yankee with a felt. This results in a flannel-like feel compared to the silky feel of conventional creping. The airside of the sheet, as in conventional wet-press creping, is less smooth than the dryerside. In a 1-ply product the airside contributes to overall softness, since it cannot be hidden to the inside as in a 2-ply product. This combination results in a lower sensory softness rating. The current approach to improving softness is to build caliper with a relatively coarse creping fabric, add a softening agent and calender with "high" load to smooth the sheet and reduce two-sidedness. The tissue (commercial) furnish, for 1-ply BRT, will be 40% Northern HW and 60% recycled fiber. In the table below, FRF is Fox River recycled wet-lap. FRF is a high brightness recycled fiber. With only a few data points, 17.5 sensory softness is the best so far. The average, thus far, is 16.9. Here the 17.0 softness target will be less of a challenge. All of the data in the tables below are for a blended basesheet. HW and SW were usually made in separate pulpers and run from different chests. The fibers are usually blended at the fan pumps creating a homogenous blend of fiber.

TABLE 3

| Furnish | Softness Adjusted to 450 GMT |
|---|---|
| 80% EUC/20% MAR | 17.6 |
| 80% SHW/20% MARSW | 16.9 |
| 40% NHW/60% FRF | 16.8 |
| 100% FRF | 16.4 |
| 80% SHW/20% SSW | 16.4 |

TABLE 4

| Furnish | Highest Softness Adjusted to 450 GMT |
|---|---|
| 80% EUC/20% MAR | 18.3 |
| 40% NHW/60% FRF | 17.5 |
| 80% SHW/20% SSW | 16.9 |
| 80% SHW/20% MARSW | 16.9 |
| 100% FRF | 16.4 |

Rubber/Steel Calendering

To reduce the two-sidedness of 1-ply BRT, a rubber roll and a conventional steel calender roll were compared to conventional steel/steel calendering. The rubber roll was placed against the dryerside of the sheet. Tables 5-7 below show the effect of calender load on basesheet caliper using rubber rolls of different hardness's. Both rubber rolls gave similar levels of caliper reduction for equivalent calender load. The steel/steel rolls gave significantly higher caliper reduction at equivalent load as seen in the chart below. The 56 P+J roll, which is harder than the (nominal) 80 P+J roll, should have given more caliper loss at equivalent load. The (nominal) 80 P+J roll had been used previously and its actual measured P+J value was 70. Its cover thickness was ⅝ inches compared to 1 inch for the 56 P+J roll. The calculated nip width for a 70 P+J roll with a ⅝-inch cover thickness is slightly less than for the 56 P+J roll with a 1-inch cover. This explains the higher caliper reduction seen with the "80 P+J" roll.

TABLE 5

| Calender Type | Calender Load, PLI | 8 Sheet Caliper, mils* | Caliper Reduction, % |
|---|---|---|---|
| 80 P + J/Steel | 0 | 88.5 | — |
| 80 P + J/Steel | 25 | 77.5 | 12.4 |
| 80 P + J/Steel | 55 | 71.1 | 19.7 |
| 80 P + J/Steel | 80 | 67.1 | 24.2 |
| 80 P + J/Steel | 100 | 64.4 | 27.2 |

*21 lb basesheet

TABLE 6

| Calender Type | Calender Load, PLI | 8 Sheet Caliper, mils* | Caliper Reduction, % |
|---|---|---|---|
| 56 P + J/Steel | 0 | 89.4 | — |
| 56 P + J/Steel | 25 | 80.0 | 11.7 |
| 56 P + J/Steel | 50 | 75.7 | 15.4 |
| 56 P + J/Steel | 50 | 75.9 | 15.1 |
| 56 P + J/Steel | 80 | 72.4 | 18.9 |
| 56 P + J/Steel | 80 | 73.2 | 18.1 |
| 56 P + J/Steel | 100 | 72.9 | 18.4 |
| 56 P + J/Steel | 200 | 65.9 | 26.3 |
| 56 P + J/Steel | 200 | 65.6 | 26.6 |

*23 lb basesheet

TABLE 7

| Calender Type | Calender Load, PLI | 8 Sheet Caliper, mils* | Caliper Reduction, % |
|---|---|---|---|
| Steel/Steel | 0 | 86.1 | — |
| Steel/Steel | 25 | 69.4 | 19.3 |
| Steel/Steel | 25 | 72.8 | 15.4 |
| Steel/Steel | 50 | 61.4 | 28.7 |
| Steel/Steel | 50 | 61.8 | 28.2 |
| Steel/Steel | 80 | 55.5 | 35.5 |
| Steel/Steel | 100 | 54.7 | 36.4 |
| Steel/Steel | 200 | 49.5 | 42.4 |

*23 lb basesheet

As calendering load increased, two-sidedness was significantly reduced for all types of calender rolls. However, the sheets calendered with rubber/steel rolls did not feel as soft as steel/steel calendered basesheets. At a given GMT, sensory softness is about 0.4 softness units higher for steel/steel-calendered sheets.

Several basesheets were calendered at different loads using the steel/steel rolls. The calendering station is located before the reel on the paper machine. These basesheets were then embossed during converting into 1-ply BRT. The chart below shows that there is little effect due to calender load on sensory softness for sheets that contained premium fiber, i.e. eucalyptus HW and Marathon SW. For the sheets containing Northern HW and Fox River Secondary Fiber, softness improved at 65 PLI calender load, but decreased when calender load was increased to 80 PLI. The Southern sheets increased in softness slightly as calender load increased. Variable process conditions and different emboss patterns make it difficult to quantify the calendering effect on softness. However, it appears that some calendering improves softness, but over-calendering degrades softness.

Spray Softener Comparison

Hercules D1152, TQ456 and TQ236 were compared as spray softeners added to the airside of the sheet. The table below shows the results. When adjusted for GMT, there was no difference in softness between the softeners. Hercules M-5118 was also tried as a spray softener. This material is a polypropylene glycol ether, as is known in the art. However, when it was sprayed on the airside of the sheet at 2 lb/T, while the sheet was on the 4-foot dryer (transfer cylinder, FIG. 3), the sheet would not stick to the creping fabric. When the spray was placed on the dryerside of the sheet, either on the felt before the suction turning roll (STR) or on the creping fabric before the solid pressure roll (SPR), the sheet would not stick to the 4-foot dryer or the Yankee dryer, respectively. The other softeners did not result in adhesion problems and did not adversely affect Yankee coating at 2 lb/T. However, at 4 lb/T and higher, all resulted in unstable Yankee coatings. Results appear in Table 8.

TABLE 8

| Emboss Pattern | Calender Rolls | Spray Softener | Softener, lb/T | Sensory Softness at 450 GMT |
|---|---|---|---|---|
| '819 | 80P + J/Steel | TQ236 | 2 | 16.1 |
| '819 | 80P + J/Steel | D1152 | 2 | 16.1 |
| '819 | 56P + J/Steel | D1152 | 2 | 16.2 |
| '819 | 56P + J/Steel | TQ456 | 2 | 16.1 |

Wet-End Softener Comparison

The wet-end addition of softeners to the thick stock (usually the HW) at levels up to 16 lb/T was possible without creating Yankee coating instability. The table below shows a comparison of Hercules TQ236, TQ456, D1152 and Clearwater CS359. All were made under similar process conditions. The steel/steel calender rolls were loaded at 50 PLI. The '819 emboss pattern was used for converting. At equivalent addition rates and GMT, all of the softeners performed the same. In the case where refining was increased to compensate for the increase in softener, which acts as a debonder, no softness improvement was seen. In this case only the Southern SW was refined and softener added only to the Southern HW. This was a test of the "few but strong bonds" theory. By refining only the SW for strength, a greater amount of softener could then be added to the HW to theoretically improve softness. Refining only the SW (20% of the sheet) did not result in a softer sheet. Although unconfirmed by the Sensory Panel, D1152 was chosen as the softener of choice primarily based on subjective evaluation of softness. Results are summarized in Table 9.

TABLE 9

| Furnish | Refiner, HP | Calender, PLI | Wet-end Softener | Softener, lb/T | Sensory Softness, 450 GMT |
|---|---|---|---|---|---|
| SHW/SW | No load | 50 | TQ236 | 4.0 | 16.5 |
| SHW/SW | 46 | 50 | TQ236 | 8.0 | 16.4 |
| SHW/SW | 42 | 50 | TQ456 | 16.0 | 16.6 |
| SHW/SW | 43 | 50 | D1152 | 4.5 | 16.2 |
| SH HW/SW | 43 | 50 | D1152 | 7.5 | 16.4 |
| SHW/SW | 43 | 50 | D1152 | 9.0 | 16.8 |
| SHW/SW | No load | 50 | CS359 | 4.0 | 16.3 |
| NHW/FRF | No load | 80 | D1152 | 8.0 | 16.8 |

Emboss Pattern Effect

Different emboss patterns were used to determine if a particular pattern interacted with the fabric creped basesheet to produce high softness. Past studies have shown that most emboss patterns do not improve basesheet softness other than by strength degradation. In most cases process conditions were similar but not constant for the comparisons that follow.

However, they were similar enough to determine if a significant softness improvement had occurred. The tables below show that no significant softness improvement can be attributed to any of the patterns tested. The "Double Hearts," "819" (U.S. Pat. No. 6,827,819) and "Butterflies and Swirls" patterns appear to give equivalent sensory softness. See Tables 10-13 below. Directionally, the "Mosaic Iris" pattern gave higher sensory softness values than the "Butterflies and Swirls with Micro" pattern. Based on this limited data, the "Butterflies and Swirls with Micro" pattern is not recommended for the fabric creped basesheet. "M3" and "Mosaic Iris" emboss patterns gave equivalent softness values, and should be considered equivalent, to those in Table 10 for constant furnish and GMT.

TABLE 10

| Southern HW/Southern SW | | | |
|---|---|---|---|
| Emboss Pattern | GMT | Sensory Softness | Softness at 450 GMT |
| Double Hearts | 493 | 16.4 | 16.6 |
| 819 | 399 | 16.6 | 16.4 |
| Butterflies and Swirls | 454 | 16.3 | 16.3 |
| Butterflies and Swirls | 421 | 16.4 | 16.3 |
| 819 | 417 | 16.4 | 16.3 |
| 819 | 420 | 16.3 | 16.2 |
| 819 | 403 | 16.3 | 16.1 |

TABLE 11

| 40% Northern HW/60% Fox River Recycled Fiber (FRF) | | | |
|---|---|---|---|
| Emboss Pattern | GMT | Sensory Softness | Softness at 450 GMT |
| Mosaic Iris | 439 | 17.5 | 17.5 |
| Butterflies and Swirls, Micro | 376 | 17.3 | 17.0 |

TABLE 12

| 40% *Eucalyptus* HW/60% Fox River Recycled Fiber (FRF) | | | | |
|---|---|---|---|---|
| Example | Emboss Pattern | GMT | Sensory Softness | Softness at 450 GMT |
| 255 | Mosaic Iris | 477 | 17.6 | 17.7 |
| 254 | Butterflies and Swirls, Micro | 451 | 17.0 | 17.0 |
| 256 | Butterflies and Swirls, Micro | 419 | 17.0 | 16.9 |

TABLE 13

| *Eucalyptus* HW/Marathon SW | | | | |
|---|---|---|---|---|
| Example | Emboss Pattern | GMT | Sensory Softness | Softness at 450 GMT |
| 271 | M3 | 428 | 18.6 | 18.5 |
| 271 | M3 | 584 | 17.8 | 18.3 |
| 257 | Mosaic Iris | 507 | 18.1 | 18.3 |
| 259 | Butterflies and Swirls, Micro | 478 | 17.9 | 18.0 |
| 258 | Butterflies and Swirls, Micro | 454 | 18.0 | 18.0 |

Fabric Crepe Versus Reel Crepe

Basesheet was produced at constant line crepe, but with a wide range of fabric crepe percents. Line crepe or overall crepe is calculated by dividing transfer cylinder speed (also appx forming speed) by reel speed. From this value, 1 is subtracted. The resulting value is multiplied by 100 and is expressed as percent. For fabric crepe, transfer cylinder speed is divided by Yankee speed, because this is also the creping fabric speed, and then 1 is subtracted and multiplied by 100. For reel crepe, the Yankee speed is divided by the reel speed and then 1 is subtracted and multiplied by 100. Generally, the transfer cylinder speed and reel speed were held constant and Yankee speed varied to create the different fabric/reel crepe conditions. Basesheet data shows that the highest MD stretch occurred at the highest reel crepe. The lowest geometric mean (GM) break modulus and highest CD stretch occurred at the highest fabric crepe. None of the sheets presented any runnability problems. Other than Yankee speed, other process variables were held constant with the exception of Yankee coating addition, which was increased for Example 56 (Table 14). In terms of physical properties, the sheets were remarkably similar for the extreme range of fabric/reel crepe conditions employed. Results are summarized in Table 14. For these trials, the transfer cylinder was a 4-foot diameter dryer.

TABLE 14

| Basesheet | | | | |
|---|---|---|---|---|
| | Example | | | |
| | 56 | 54 | 55 | 57 |
| 4' Dryer Speed | 2401 | 2403 | 2400 | 2399 |
| Yankee Speed | 2200 | 1800 | 1530 | 1400 |
| Reel Speed | 1423 | 1402 | 1399 | 1400 |
| Fabric Crepe, % | 9 | 34 | 57 | 71 |
| Reel Crepe, % | 55 | 28 | 9 | 0 |
| Line Crepe, % | 69 | 71 | 72 | 71 |
| Basis Weight | 24.2 | 23.3 | 24.5 | 24.0 |
| 8 Sheet Caliper | 72.6 | 73.4 | 74.0 | 70.9 |
| MD Tensile | 569 | 510 | 545 | 499 |
| MD Stretch | 68.4 | 59.3 | 62.3 | 59.7 |
| CD Tensile | 676 | 617 | 682 | 610 |
| CD Stretch | 6.4 | 6.0 | 6.8 | 8.4 |
| GM Tensile | 620 | 561 | 608 | 552 |
| MD/CD Ratio | 0.84 | 0.83 | 0.80 | 0.82 |
| GM Break Mod | 29 | 30 | 29 | 25 |
| MD Break Mod | 8 | 9 | 9 | 8 |
| CD Break Mod | 101 | 103 | 99 | 73 |

All sheets were converted into finished 1-ply BRT rolls using either no emboss pattern or a pattern as described in U.S. Pat. No. 6,827,819. Physical data seen in the Tables 15 and 16 below was very similar to the basesheet data from above. The sheets with all fabric crepe and no reel crepe (Ex. 57) had significantly higher CD stretch and lower CD break modulus. GM modulus was directionally lower. However, sensory softness data indicated no softness advantage for any of the sheets (Tables 15 and 16).

TABLE 15

| Converted, '819 Pattern | | | | |
|---|---|---|---|---|
| | Example | | | |
| | 212 | 208 | 210 | 214 |
| Fabric Crepe, % | 9 | 34 | 57 | 71 |
| Reel Crepe, % | 55 | 28 | 9 | 0 |

TABLE 15-continued

| | Converted, '819 Pattern | | | |
|---|---|---|---|---|
| | Example | | | |
| | 212 | 208 | 210 | 214 |
| Line Crepe, % | 69 | 71 | 72 | 71 |
| Sensory Softness | 16.2 | 16.1 | 15.9 | 16.2 |
| Basis Weight | 20.7 | 20.7 | 22.1 | 21.7 |
| 8 Sheet Caliper | 75.8 | 73.7 | 76.4 | 72.9 |
| MD Tensile | 505 | 457 | 498 | 444 |
| MD Stretch | 36.8 | 37.7 | 40.0 | 38.6 |
| CD Tensile | 447 | 446 | 514 | 427 |
| CD Stretch | 6.8 | 6.7 | 6.7 | 7.8 |
| GM Tensile | 475 | 451 | 506 | 435 |
| MD/CD Ratio | 1.13 | 1.03 | 0.97 | 1.04 |
| GM Break Mod | 30.1 | 28.5 | 30.9 | 25.1 |
| MD Break Mod | 13.7 | 12.1 | 12.5 | 11.5 |
| CD Break Mod | 66.1 | 67.1 | 76.5 | 54.9 |

TABLE 16

| | No Emboss | | | |
|---|---|---|---|---|
| | Example | | | |
| | 211 | 207 | 210 | 213 |
| Fabric Crepe, % | 9 | 34 | 57 | 71 |
| Reel Crepe, % | 55 | 28 | 9 | 0 |
| Line Crepe, % | 69 | 71 | 72 | 71 |
| Sensory Softness | 15.4 | 15.8 | 15.2 | 15.7 |
| Basis Weight | 22.6 | 22.6 | 23.4 | 24.2 |
| 8 Sheet Caliper | 70.1 | 68.7 | 67.3 | 67.0 |

TABLE 16-continued

| | No Emboss | | | |
|---|---|---|---|---|
| | Example | | | |
| | 211 | 207 | 210 | 213 |
| MD Tensile | 567 | 493 | 496 | 536 |
| MD Stretch | 50.8 | 46.6 | 45.4 | 47.5 |
| CD Tensile | 561 | 559 | 628 | 583 |
| CD Stretch | 5.0 | 5.5 | 6.0 | 6.9 |
| GM Tensile | 564 | 525 | 558 | 559 |
| MD/CD Ratio | 1.01 | 0.88 | 0.79 | 0.92 |
| GM Break Mod | 35.3 | 32.8 | 33.8 | 30.9 |
| MD Break Mod | 11.1 | 10.6 | 10.9 | 11.3 |
| CD Break Mod | 111.9 | 101.7 | 104.9 | 84.4 |

Creping Fabric Effect

Various creping fabric designs were used to produce basesheets for converting into 1-ply BRT. Table 17 below shows basesheet data under similar process conditions. In the crepe fabric type row, the MD and CD filament counts are shown as 42×31, for example. The MD count is shown first. MD or CD refers to the longest knuckle on the side of the fabric against the sheet. M, G and B refer to weave styles. The highest uncalendered caliper was achieved with the 56×25 mesh fabrics. This allowed for higher levels of calendering while still achieving the target roll diameter and firmness in converted product. Higher levels of calendering should reduce two-sidedness and may improve softness.

TABLE 17

| | Basesheet | | | | | |
|---|---|---|---|---|---|---|
| Crepe Fabric Type | 44G, CD (42X31) | 56X45M, MD | 56X25G, MD | 56X25G, CD | 36X32B, MD | 56X25M, CD |
| Basis Weight, Uncalendered | 23.9 | 24.2 | 23.8 | 24.5 | 24.2 | — |
| 8 Sheet Caliper, Uncalendered | 87 | 91 | 102 | 103 | 98 | — |
| Calender, PLI | 20 | 50 | 80 | 80 | 50 | 50 |
| Basis Weight, Calendered | 23.2 | 24.0 | 23.0 | 23.7 | 23.0 | 21.3 |
| 8 Sheet Caliper, Calendered | 78.7 | 63.9 | 63.9 | 67.6 | 68.1 | 63.6 |

When converted using the '819 pattern, the 56×25G sheets, at 80 PLI calendering, had directionally higher sensory softness.

MD/CD Tensile Ratio Effect

The fabric crepe process has the ability to easily control MD/CD tensile ratio over a much wider range than conventional wet-press and TAD processes. Ratios of 4.0 to 0.4 have been produced without pushing the process to its limits. Traditionally, tissue products required that MD tensile be higher than CD tensile to maximize formation. For maximum softness, CD tensile was kept as low as possible. This increases the risk of failure in use by consumers. If CD tensile could be increased and MD tensile decreased, GMT would remain constant. Therefore, at equivalent overall strength there would be less chance of failure. The table below shows 1-ply finished BRT data for two separate trials in which MD/CD tensile ratio was varied. Compare examples 90, 89 107 and 108 in Table 18 below. Reducing the MD/CD ratio increased both CD and GM modulus. However, sensory softness was not significantly affected when GMT was accounted for. CD strength was increased by about 100 grams/3 inches. This should greatly reduce the risk of failure in use. The stretchy nature of the basesheet could prevent breaks due to low strength. For high-speed commercial operation, perf blade type may need to be changed to accommodate low strength and high stretch.

TABLE 18

| | Furnish | | | |
|---|---|---|---|---|
| | 80% EUC 20% MAR | 80% EUC 20% MAR | 70% NAHHW 30% NAHSW | 70% NAHHW 30% NAHSW |
| | Example | | | |
| | 90 | 89 | 107 | 108 |
| MD/CD | 1.78 | 1.18 | 1.37 | 0.91 |
| Sensory Softness | 18.2 | 17.7 | 16.3 | 16.4 |
| Softness at 450 GMT | 17.9 | 17.6 | 16.1 | 16.3 |
| GMT | 371 | 427 | 403 | 417 |
| BW | 20.3 | 20.2 | 20.3 | 20.4 |
| Caliper | 63.3 | 65.9 | 67.0 | 67.8 |
| MD Tensile | 494 | 463 | 471 | 397 |
| CD Tensile | 278 | 393 | 345 | 438 |
| MD Stretch | 25.0 | 24.4 | 37.6 | 34.1 |
| CD Stretch | 7.8 | 5.9 | 8.7 | 7.1 |
| MD Break Mod | 19.8 | 19.0 | 12.6 | 11.7 |
| CD Break Mod | 35.9 | 67.0 | 39.8 | 61.1 |
| GM Break Mod | 26.6 | 35.7 | 22.4 | 26.7 |

Southern HW Level

The effect of Southern HW level on sensory softness is shown in Table 19 below. No softness improvement at 75% HW was observed. In both cases softness was well below the target of 17.0. The 80 P+J rubber/steel calendering rolls were used.

TABLE 19

| Example | Emboss Pattern | Southern HW, % | Sensory Softness at 450 GMT |
|---|---|---|---|
| 196 | '819 | 75 | 16.2 |
| 200 | '819 | 50 | 16.1 |

Fabric Crepe Versus Spray Softener

Process variables were manipulated to determine which, if any, would result in a finished product sensory softness of 17.0 using Southern HW and SW. One such comparison was between a basesheet with no spray softener using high fabric crepe to control strength and low fabric crepe using spray softener to control strength. Table 20 shows that softness was equivalent when adjusted for GMT. In both cases softness was well below the target of 17.0. The 80 P+J rubber/steel calendering rolls were used.

TABLE 20

| PM #2 Roll # | Emboss Pattern | Spray Softener, lb/T | Fabric Crepe, % | Sensory Softness at 450 GMT |
|---|---|---|---|---|
| 200 | '819 | 2 | 31 | 16.1 |
| 198 | '819 | 0 | 56 | 16.1 |

Molding Box Vacuum

The molding box was located on the creping fabric, between the crepe roll and the solid pressure roll. Sheet solids were usually between 38 and 44% at this point. The effect of vacuum on sheet caliper can be seen in the table. An increase of almost 8 mils of "8-sheet caliper" was observed with 21 inches of mercury vacuum at the molding box. This is about a 14% increase. Both rolls were calendered at 50 PLI with steel/steel rolls. The amount of caliper development is dependent on the coarseness of the fabric weave and the amount of vacuum applied. Other sheet properties were not significantly affected. Drying was affected by use of the molding box. Without a significant change in Yankee hood temperature, sheet moisture after the Yankee increased from 2.66 to 3.65%. Vacuum pulls the sheet deeper into the creping fabric, therefore, there is less contact with the Yankee and more drying is required to maintain sheet moisture. See Table 21. In this case the Yankee hood temperatures were not adjusted.

TABLE 21

| Creping Fabric | Molding Box Vacuum, in. Hg | 8 Sheet Caliper, mils | Scanner Sheet Moisture, % |
|---|---|---|---|
| 44G | 0 | 56.7 | 2.66 |
| 44G | 21 | 64.6 | 3.65 |

Effect of Sheet Moisture, at Fabric Crepe, On Basesheet Properties

By manipulating process variables, sheet moisture coming into the fabric creping part of the process can be varied. On the papermachine employed, equipped with a 120 mm shoe-press and 22 lb sheet, solids could be varied from about 34 to 46%. For the low solids condition, STR vacuum was reduced, shoe-press load was reduced and 4-foot dryer steam reduced. To dry this sheet to about 2% moisture at the reel, Yankee steam and hood temperature had to be increased. The low solids basesheet was about 270 grams/3 in. lower in GMT than the high solids sheet. See the table below. This was primarily due to the lower compaction that takes place at lower shoe-press loading. The fabric creping step rearranged the fibers to a great extent, but apparently it was not able to completely undo all of the compaction of pressing. Other physical properties, including SAT capacity, were not significantly different when the strength difference was taken into account. This experiment should be repeated at constant pressing by using only vacuum and steam to alter sheet solids.

However, based on this experiment, the effect of sheet solids on basesheet properties in the range studied here is not expected to be significant. The drying impact is significant and it would be worthwhile to expand the range of solids tested. Results are summarized on Table 22 below.

TABLE 22

| | "Low" Solids Fabric Creping | "High" Solids Fabric Creping |
|---|---|---|
| | Example | |
| | 94 | 95 |
| Sheet Solids Before Fabric Creping | 33.8 | 46.1 |
| Yankee Hood Temperature | 950 | 550 |
| Yankee Steam PSI | 110 | 105 |
| Suction Turning Roll Vacuum | 7.9 | 13.1 |
| Shoe-press Load, PLI | 200 | 500 |
| 4-Foot Dryer Steam | 25 | 70 |
| BW | 22.3 | 22.8 |
| Caliper | 91.2 | 85.2 |
| MD Tensile | 976 | 1236 |
| MD Stretch | 52.2 | 53.7 |
| CD Tensile | 1205 | 1481 |
| CD Stretch | 5.8 | 5.6 |
| GMT | 1084 | 1353 |
| MD/CD | 0.81 | 0.83 |
| GM Break Mod | 61 | 78 |
| CD Break Mod | 205 | 261 |
| MD Break Mod | 18 | 24 |
| SAT Capacity | 190 | 168 |

While the invention has been described in connection with several examples, modifications to those examples within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary.

What is claimed is:

1. An absorbent sheet of cellulosic fibers comprising a mixture of hardwood fibers and softwood fibers arranged in a reticulum having: (i) a plurality of pileated fiber enriched regions of relatively high local basis weight interconnected by way of (ii) a plurality of lower local basis weight linking regions whose fiber orientation is biased along the direction between pileated regions interconnected thereby, wherein the relative basis weight, degree of pileation, hardwood to softwood ratio, fiber length distribution, fiber orientation, and geometry of the reticulum are controlled such that the sheet exhibits a % CD stretch which is at least about 2.75 times the MD/CD dry tensile ratio of the sheet, and wherein the sheet exhibits a percent CD stretch of at least about 4 and a dry tensile ratio of from about 0.4 to about 4.

2. The absorbent cellulosic sheet according to claim 1, exhibiting a void volume of at least about 5 g/g, a CD stretch of at least about 5 percent, and an MD/CD tensile ratio of less than about 1.75.

3. The absorbent cellulosic sheet according to claim 1, exhibiting a void volume of at least about 5 g/g, a CD stretch of at least about 5 percent, and an MD/CD tensile ratio of less than about 1.5.

4. The absorbent cellulosic sheet according to claim 1, exhibiting a void volume of at least about 5 g/g, a CD stretch of at least about 10 percent, and an MD/CD tensile ratio of less than about 2.5.

5. The absorbent cellulosic sheet according to claim 1, exhibiting a void volume of at least about 5 g/g, a CD stretch of at least about 15 percent, and an MD/CD tensile ratio of less than about 3.5.

6. The absorbent cellulosic sheet according to claim 1, exhibiting an absorbency of at least about 5 g/g, a CD stretch of at least about 20 percent, and an MD/CD tensile ratio of less than about 5.

7. The absorbent cellulosic sheet according to claim 1, exhibiting a percent CD stretch which is at least about 3 times the dry tensile ratio of the sheet.

8. The absorbent cellulosic sheet according to claim 1, exhibiting a percent CD stretch which is at least about 3.25 times the dry tensile ratio of the sheet.

9. The absorbent cellulosic sheet according to claim 1, exhibiting a percent CD stretch which is at least about 3.5 times the dry tensile ratio of the sheet.

10. The absorbent cellulosic sheet according to claim 1, wherein the sheet exhibits a percent CD stretch of at least about 5.

11. The absorbent cellulosic sheet according to claim 1, wherein the sheet exhibits a percent CD stretch of at least about 6.

12. The absorbent cellulosic sheet according to claim 1, wherein the sheet exhibits a percent CD stretch of at least about 8.

13. The absorbent cellulosic sheet according to claim 1, wherein the sheet exhibits a percent CD stretch of at least about 10.

14. The absorbent sheet according to claim 1, having a void volume of at least 6 g/g.

15. The absorbent sheet according to claim 1, having a void volume of at least 7 g/g.

16. The absorbent sheet according to claim 1, having a void volume of at least 8 g/g.

17. The absorbent sheet according to claim 1, having a void volume of at least 9 g/g.

18. The absorbent sheet according to claim 1, having a void volume of at least 10 g/g.

19. The absorbent sheet according to claim 1, consisting predominantly of hardwood fiber.

20. The absorbent sheet according to claim 1, consisting predominantly of softwood fiber.

21. An absorbent sheet of cellulosic fibers comprising a mixture of hardwood fibers and softwood fibers arranged in a reticulum having: (i) a plurality of pileated fiber enriched regions of relatively high local basis weight interconnected by way of(ii) a plurality of lower local basis weight linking regions whose fiber orientation is biased along the direction between pileated regions interconnected thereby, wherein the relative basis weight, degree of pileation, hardwood to softwood ratio, fiber length distribution, fiber orientation, and geometry of the reticulum are controlled such that the sheet exhibits a % CD stretch which is at least 2.75 times the MD/CD dry tensile ratio of the sheet, M MD/CD tensile ratio, with the proviso the sheet has a CD stretch of 3.5% or more.

22. The absorbent sheet according to claim 21, wherein the sheet exhibits a CD stretch of at least 4%.

* * * * *